US012207776B2

(12) United States Patent
Ellingson

(10) Patent No.: US 12,207,776 B2
(45) Date of Patent: Jan. 28, 2025

(54) MACHINE LEARNING CLASSIFICATION OR SCORING OF CLEANING OUTCOMES IN CLEANING MACHINES

(71) Applicant: Ecolab USA Inc., St. Paul, MN (US)

(72) Inventor: Alissa R. Ellingson, Woodbury, MN (US)

(73) Assignee: Ecolab USA Inc., St. Paul, MN (US)

( * ) Notice: Subject to any disclaimer, the term of this patent is extended or adjusted under 35 U.S.C. 154(b) by 340 days.

(21) Appl. No.: 17/193,314

(22) Filed: Mar. 5, 2021

(65) Prior Publication Data

US 2022/0095879 A1 Mar. 31, 2022

Related U.S. Application Data

(60) Provisional application No. 63/083,355, filed on Sep. 25, 2020.

(51) Int. Cl.
*A47L 15/00* (2006.01)

(52) U.S. Cl.
CPC ..... *A47L 15/0021* (2013.01)

(58) Field of Classification Search
None
See application file for complete search history.

(56) References Cited

U.S. PATENT DOCUMENTS

D227,117 S 6/1973 Breger
4,735,219 A 4/1988 Seeland
D427,315 S 6/2000 Saltzstein et al.
6,463,940 B1 10/2002 Thomas et al.
6,615,850 B1 9/2003 Hornung
6,622,754 B1 9/2003 Roth et al.
(Continued)

FOREIGN PATENT DOCUMENTS

CA 2541480 A1 9/2006
CN 101961237 A 2/2011
(Continued)

OTHER PUBLICATIONS

KR102119076 English translation, accessed on Sep. 2023. (Year: 2020).*

(Continued)

*Primary Examiner* — Eric W Golightly
*Assistant Examiner* — Arlyn I Rivera-Cordero
(74) *Attorney, Agent, or Firm* — Shumaker & Sieffert, P.A.

(57) ABSTRACT

An automated cleaning machine includes a trained cleaning outcome classifier that automatically classifies or scores cleaning outcomes for a cleaning machine using machine learning techniques. The cleaning outcome classifier may be trained on training data comprising a plurality of training inputs and a known output for each of the plurality of training inputs. Each of the plurality of training inputs may include one or more cleaning process parameters corresponding to a cleaning process executed by a cleaning machine executed during a training phase. The known output for each training input may include a cleaning outcome classification or score. The cleaning outcome of a novel cleaning process may then be classified or scored with the trained cleaning outcome classifier based on one or more cleaning process parameters corresponding to the novel cleaning process.

13 Claims, 13 Drawing Sheets

(56) References Cited

U.S. PATENT DOCUMENTS

| | | | | |
|---|---|---|---|---|
| 7,437,213 | B2 | 10/2008 | Batcher | |
| D605,588 | S | 12/2009 | Nomi et al. | |
| D677,669 | S | 3/2013 | Liu | |
| D699,246 | S | 2/2014 | Ringlein | |
| D715,284 | S | 10/2014 | Iwamoto | |
| 9,041,985 | B2 | 5/2015 | Kasahara et al. | |
| D730,886 | S | 6/2015 | Tseng | |
| 9,289,107 | B2 | 3/2016 | Ellingson et al. | |
| 9,329,159 | B2 | 5/2016 | Walicki | |
| D768,138 | S | 10/2016 | Malsan | |
| 9,473,653 | B2 | 10/2016 | Hayashi | |
| D788,778 | S | 6/2017 | Magi et al. | |
| D795,323 | S | 8/2017 | Melamed et al. | |
| D808,947 | S | 1/2018 | Taniho et al. | |
| D837,180 | S | 1/2019 | Silva | |
| 10,514,339 | B2 | 12/2019 | Chen et al. | |
| D872,072 | S | 1/2020 | Anderson | |
| 10,529,219 | B2 | 1/2020 | Herdt et al. | |
| 10,762,617 | B2 | 9/2020 | Sanders et al. | |
| 11,627,861 | B2 | 4/2023 | Smith et al. | |
| 11,666,198 | B2 | 6/2023 | Han et al. | |
| 2005/0201898 | A1 | 9/2005 | Borich et al. | |
| 2006/0222567 | A1 | 10/2006 | Kloepfer et al. | |
| 2007/0181162 | A1 | 8/2007 | Classen et al. | |
| 2008/0267445 | A1 | 10/2008 | Capewell | |
| 2009/0151751 | A1 | 6/2009 | Bragg | |
| 2010/0205819 | A1 | 8/2010 | Ashrafzadeh et al. | |
| 2011/0108073 | A1 | 5/2011 | Tameishi | |
| 2011/0209729 | A1 | 9/2011 | Beaudet et al. | |
| 2011/0291830 | A1 | 12/2011 | Kaiser | |
| 2011/0320133 | A1 | 12/2011 | Mehus et al. | |
| 2012/0138092 | A1 | 6/2012 | Ashrafzadeh et al. | |
| 2014/0041688 | A1 | 2/2014 | Maennle et al. | |
| 2014/0041695 | A1 | 2/2014 | Ellingson et al. | |
| 2014/0218385 | A1 | 8/2014 | Carmi | |
| 2015/0233898 | A1 | 8/2015 | Chen et al. | |
| 2016/0171690 | A1 | 6/2016 | Adiri et al. | |
| 2017/0023542 | A1 | 1/2017 | Wang et al. | |
| 2017/0119232 | A1 | 5/2017 | Ugel et al. | |
| 2018/0330338 | A1 | 11/2018 | Holden et al. | |
| 2019/0244375 | A1 | 8/2019 | Choi et al. | |
| 2019/0261828 | A1 * | 8/2019 | Gaus | A47L 15/4289 |
| 2019/0365197 | A1 | 12/2019 | Maddux | |
| 2020/0301382 | A1 | 9/2020 | Fawaz et al. | |
| 2020/0397216 | A1 | 12/2020 | Fawaz et al. | |
| 2021/0019874 | A1 | 1/2021 | Sanders et al. | |
| 2021/0076898 | A1 | 3/2021 | Smith et al. | |
| 2021/0127939 | A1 | 5/2021 | Hofmann et al. | |
| 2021/0161355 | A1 | 6/2021 | Rahn et al. | |
| 2021/0324561 | A1 | 10/2021 | Kim et al. | |
| 2021/0369076 | A1 | 12/2021 | McGinness et al. | |
| 2022/0104680 | A1 | 4/2022 | Han et al. | |
| 2023/0218137 | A1 | 7/2023 | Smith et al. | |
| 2023/0337891 | A1 | 10/2023 | Han et al. | |

FOREIGN PATENT DOCUMENTS

| | | | | |
|---|---|---|---|---|
| CN | 107485356 | A | 12/2017 | |
| CN | 107729816 | A | 2/2018 | |
| CN | 104668252 | B | 1/2019 | |
| CN | 110367898 | A | 10/2019 | |
| CN | 107421918 | B | 12/2019 | |
| CN | 111870205 | A | 11/2020 | |
| DE | 102005033345 | A1 | 1/2007 | |
| DE | 102008042290 | A1 | 3/2010 | |
| DE | 102010033016 | A1 | 2/2012 | |
| DE | 102018108775 | * | 10/2019 | A47L 15/0021 |
| DE | 102018108775 | A1 | 10/2019 | |
| EP | 0341766 | A2 | 11/1989 | |
| EP | 1272093 | A2 | 1/2003 | |
| EP | 1690924 | A1 | 8/2006 | |
| EP | 1887443 | A1 | 2/2008 | |
| EP | 2497404 | A1 | 9/2012 | |
| EP | 3088593 | A1 | 11/2016 | |
| JP | 61280838 | A | 12/1986 | |
| JP | 02274289 | A | 11/1990 | |
| JP | 05115418 | A | 5/1993 | |
| JP | 0663279 | A | 3/1994 | |
| JP | 2000316783 | A | 11/2000 | |
| JP | 2002336335 | A | 11/2002 | |
| JP | 2003038888 | A | 2/2003 | |
| JP | 2003506153 | A | 2/2003 | |
| JP | 2004261439 | A | 9/2004 | |
| JP | 2005342143 | A | 12/2005 | |
| JP | 2009056030 | A | 3/2009 | |
| JP | 2009075084 | A | 4/2009 | |
| JP | 2010036023 | A | 2/2010 | |
| JP | 2015008914 | A | 1/2015 | |
| JP | 2015504708 | A | 2/2015 | |
| JP | 2016193169 | A | 11/2016 | |
| JP | 2018068862 | A | 5/2018 | |
| JP | 2018524107 | A | 8/2018 | |
| KR | 102019102134 | A | 8/2019 | |
| KR | 102119076 | * | 6/2020 | A47L 15/0018 |
| KR | 102119076 | B1 * | 6/2020 | A47L 15/0018 |
| WO | 9930843 | A1 | 6/1999 | |
| WO | 0110472 | A1 | 2/2001 | |
| WO | 0178573 | A2 | 10/2001 | |
| WO | 0213136 | A2 | 2/2002 | |
| WO | 2006002123 | A1 | 1/2006 | |
| WO | 2006097294 | A1 | 9/2006 | |
| WO | 2007081004 | A1 | 7/2007 | |
| WO | 2010118124 | A2 | 10/2010 | |
| WO | 2011048575 | A2 | 4/2011 | |
| WO | 2011089094 | A1 | 7/2011 | |
| WO | 2013090443 | A1 | 6/2013 | |
| WO | 2014137540 | A1 | 9/2014 | |
| WO | 2015036311 | A1 | 3/2015 | |
| WO | 2015080965 | A1 | 6/2015 | |
| WO | 2015127547 | A1 | 9/2015 | |
| WO | 2015167574 | A1 | 11/2015 | |
| WO | 2017013615 | A1 | 1/2017 | |
| WO | 2017056002 | A1 | 4/2017 | |

OTHER PUBLICATIONS

DE102018108775 English translation, accessed on Sep. 2023. (Year: 2019).*

KR-102119076 English translation, accessed on Mar. 2024. (Year: 2020).*

Notice of Allowance from U.S. Appl. No. 17/018,363 dated Jul. 14, 2022, 14 pp.

Advisory Action from U.S. Appl. No. 17/193,189 dated Aug. 3, 2023, 3 pp.

Notice of Allowability from U.S. Appl. No. 17/108,894 dated Jul. 26, 2023, 8 pp.

Response to Office Action mailed May 26, 2023, from U.S. Appl. No. 17/193,189, filed Jul. 26, 2023, 14 pp.

"CDWA Cleaning Indicator—Cleaning Performance Test," Terragene, retrieved on Feb. 13, 2019, from https://fontlab2000.com/sites/default/files/cdwa-rev.15.pdf, 2 pp.

"NSF/ANSI 3—2017-Commercial Warewashing Equipment," NSF International, ANSI Standard, Apr. 11, 2017, 42 pp.

"Two-Class Logistic Regression," retrieved from https://docs.microsoft.com/en-us/azure/machine-learning/studio-module-reference/two-class-logistic-regression, May 6, 2019, 7 pp.

Brownlee, "A Tour of Machine Learning Algorithms," machinelearningmastery.com, Aug. 14, 2020, 11 pp.

Kumar et al., "A Detailed Review of Feature Extraction in Image Processing Systems," 2014 Fourth International Conference on Advanced Computing & Communication Technologies, Feb. 8, 2014, 8 pp.

Narkhede, "Understanding AUC—ROC Curve," towardsdatascience.com, Jun. 26, 2018, 7 pp.

Narkhede, "Understanding Confusion Matrix," towardsdatascience.com, May 9, 2018, 6 pp.

Patel, "Machine Learning Algorithm Overview," medium.com, Jul. 21, 2018, 10 pp.

Powered for iPhone: Wireless Charging Stand for iPhone 8 and Above, Logitech POWERED iPhone Wireless Charging Standard,

(56) References Cited

OTHER PUBLICATIONS retrieved from https://www.logitech.com/en-us/productlpowered-iphone-wireless-charging?crid=1537 on Mar. 4, 2019, 10 pp.
Saslow, "Collinearity-What it Means, Why its Bad, and How Does it Affect Other Models," medium.com, Jul. 11, 2018, 5 pp.
Shung, "Accuracy, Precision, Recall or F1?," towardsdatascience.com, Mar. 15, 2018, 7 pp.
Singh, "Model-Based Feature Importance," towardsdatascience.com, Jan. 3, 2019, 7 pp.
Youtube, "Regularization Part 1: Ridge (L2) Regression," retrieved from https://www.youtube.com/watch?app=desktop&v=Q81RR3yKn30&t=3s, Sep. 24, 2018, 1 pp.
Youtube, "Regularization Part 2: Lasso (L1) Regression," Retrieved from https://www.youtube.com/watch?app=desktop&v=NGfOvoTMIcs, Oct. 1, 2018, 1 pp.
International Search Report and Written Opinion of International Application No. PCT/US2021/021095, mailed Jun. 8, 2021, 17 pp.
Corrected Notice of Allowance from U.S. Appl. No. 17/193,507, dated Feb. 2, 2023, 5 pp.
Notice of Allowance from U.S. Appl. No. 17/193,507 dated Jan. 25, 2023, 10 pp.
Response to Office Action dated Nov. 8, 2022 from U.S. Appl. No. 17/193,189, filed Feb. 8, 2023, 16 pp.
Notice of Allowance from U.S. Appl. No. 17/018,363 dated Oct. 4, 2022, 8 pp.
Office Action from U.S. Appl. No. 17/193,189 dated Nov. 8, 2022, 30 pp.
Corrected Notice of Allowance from U.S. Appl. No. 17/193,507, dated Mar. 15, 2023, 5 pp.
Final Office Action from U.S. Appl. No. 17/108,894 dated Apr. 5, 2023, 9 pp.
Final Office Action from U.S. Patent Application No. 17/193,189 dated May 26, 2023, 32 pp.
International Preliminary Report on Patentability from International Application No. PCT/US2021/021095 dated Apr. 6, 2023, 11 pp.
Notice of Allowability from U.S. Appl. No. 17/193,507 dated Apr. 28, 2023, 5 pp.
Response to Final Office Action dated Apr. 5, 2023 from U.S. Appl. No. 17/108,894, filed Jun. 5, 2023, 12 pp.
Response to Office Action dated Dec. 20, 2022 from U.S. Appl. No. 17/108,894, filed Mar. 20, 2023, 10 pp.
Advisory Action from U.S. Appl. No. 17/108,894 dated Jun. 23, 2023, 3 pp.
Office Action from U.S. Appl. No. 17/108,894 dated Dec. 20, 2022, 9 pp.
Supplemental Notice of Allowance from U.S. Appl. No. 17/018,363 dated Dec. 14, 2022, 8 pp.
Response to Office Action dated Dec. 16, 2021, from U.S. Appl. No. 17/018,363, filed Mar. 16, 2022, 15 pp.
Machine Translation of CN 107729816 by Shan et al., published Feb. 23, 2018, 17 Pages.
Office Action from U.S. Appl. No. 17/018,363, dated Dec. 16, 2021, 23 pp.
Notice of Allowance from U.S. Appl. No. 17/193,189 dated Sep. 27, 2023, 14 pp.
Response to Communication Pursuant to Rules 161(1) and 162 EPC dated May 4, 2023, from counterpart European Application No. 21715369.1, filed Nov. 2, 2023, 16 pp.
Office Action from U.S. Appl. No. 17/108,894, dated Dec. 21, 2023, 8 pp.
U.S. Appl. No. 18/398,859, filed Dec. 28, 2023, by McGinness et al.
Response to Office Action dated Dec. 21, 2023 from U.S. Appl. No. 17/108,894, filed Mar. 21, 2024, 16 pp.
Notice of Allowance from U.S. Appl. No. 17/108,894, dated Jun. 27, 2024, 7 pp.
Notice of Allowance from U.S. Appl. No. 17/108,894 dated Aug. 16, 2024, 5 pp.

* cited by examiner

Feature Weights

| Feature | Weight |
|---|---|
| Bias | 4.64857 |
| Conductivity | -4.07743 |
| WashTime | -1.54743 |
| Rinse T | -1.40809 |
| RinseTime | -1.10345 |
| Wash T | -0.499256 |

Summary of Classification Model Results

| | | Logistic Regression | | Boosted Decision Tree | | Neural Network | | Bayes Point Machine | | Support Vector Machine | |
|---|---|---|---|---|---|---|---|---|---|---|---|
| Feature Set | Features | All Rack Positions | Rack Position 1 | All Rack Positions | Rack Position 1 | All Rack Positions | Rack Position 1 | All Rack Positions | Rack Position 1 | All Rack Positions | Rack Position 1 |
| A | wash time, rinse time, wash temp, rinse temp, conductivity | 81.2% | 92.1% | 91.6% | 76.3% | 78.6% | | 74.0% | | 81.8% | |
| B | wash time, rinse time, wash temp, rinse temp, conductivity, detergent type, rinse aid type | 81.2% | 81.6% | 90.9% | 76.3% | | | | | | |
| C | wash time, rinse time, wash temp, rinse temp, conductivity, detergent type, rinse aid type, water hardness titration, alkalinity titration | 88.3% | 94.7% | 94.8% | 92.1% | | | | | | |
| D | wash time, rinse time, wash temp, rinse temp, conductivity, detergent type, rinse aid type, water hardness titration, alkalinity titration, food soil | 90.3% | 94.7% | 94.8% | 92.1% | | | | | | |

FIG. 7

Summary of Regression Model Results

| | | Linear Regression | | Boosted Decision Tree Regression | | Neural Network Regression | | Bayesian Linear Regression | |
|---|---|---|---|---|---|---|---|---|---|
| | | %Removal_RG | FUI AvgGrayVal | %Removal_RG | FUI AvgGrayVal | %Removal_RG | FUI AvgGrayVal | %Removal_RG | FUI AvgGrayVal |
| Feature Set | Features | All Rack Positions | All Rack Positions | All Rack Positions | All Rack Positions | All Rack Positions | All Rack Positions | All Rack Positions | All Rack Positions |
| A | wash time, rinse time, wash temp, rinse temp, conductivity | 0.335 | 0.383 | 0.705 | 0.625 | 0.253 | | 0.315 | |
| B | wash time, rinse time, wash temp, rinse temp, conductivity, detergent type, rinse aid type | 0.444 | 0.424 | 0.712 | 0.621 | | | | |
| C | wash time, rinse time, wash temp, rinse temp, conductivity, detergent type, rinse aid type, water hardness titration, alkalinity titration | 0.600 | 0.590 | 0.769 | 0.691 | | | | |
| D | wash time, rinse time, wash temp, rinse temp, conductivity, detergent type, rinse aid type, water hardness titration, alkalinity titration, food soil | 0.606 | 0.619 | 0.769 | 0.691 | 0.764 | | 0.609 | |

Can Get 0.926 by adding Rack Position as a categorical feature

FIG. 8

MACHINE LEARNING CLASSIFICATION OR SCORING OF CLEANING OUTCOMES IN CLEANING MACHINES

This application claims the benefit of U.S. Provisional Application No. 63/083,355, titled, "MACHINE LEARNING CLASSIFICATION OR SCORING OF CLEANING OUTCOMES IN CLEANING MACHINES," filed Sep. 25, 2020, the entire content of which is incorporated herein by reference.

BACKGROUND

Automated cleaning machines are used in restaurants, healthcare facilities, and other locations to clean, disinfect, and/or sanitize various articles. In a restaurant or food processing facility, automated cleaning machines (e.g., ware wash machines or dish machines) may be used to clean food preparation and eating articles, such as dishware, glassware, pots, pans, utensils, food processing equipment, and other items. In general, articles to be cleaned are placed on a rack and provided to a wash chamber of the automated cleaning machine. In the chamber, one or more cleaning products and/or rinse agents are applied to the articles during a cleaning process. The cleaning process may include one or more wash phases and one or more rinse phases. At the end of the cleaning process, the rack is removed from the wash chamber. Water temperature, water pressure, water quality, concentration of the chemical cleaning and/or rinse agents, duration of the wash and/or rinse phases and other factors may impact the efficacy of a cleaning process.

SUMMARY

In general, the disclosure is directed to systems and/or methods of automatically classifying or scoring cleaning outcomes for a cleaning machine using machine learning techniques. For example, a cleaning outcome classifier may be trained on training data comprising a plurality of training inputs and a known output for each of the plurality of training inputs. Each of the plurality of training inputs may include one or more cleaning process parameters corresponding to a cleaning process executed by a cleaning machine during a training phase. The known output for each training input may include a cleaning outcome classification or score. The cleaning process parameters may include, for example, one or more of a wash temperature, a rinse temperature, a wash time, a rinse time, a conductivity of the wash water, a detergent type, a rinse aid type, a water hardness of the wash water, an alkalinity of the wash water, and/or a measurement of food soil presence in the wash water. The result of the training phase is a trained cleaning outcome classifier. The cleaning outcome of a novel cleaning process may be classified or scored with the trained cleaning outcome classifier based on one or more cleaning process parameters corresponding to the novel cleaning process.

In one example, the disclosure is directed to an automated cleaning machine comprising at least one processor; at least one storage device that stores one or more predefined cleaning process parameters and a trained cleaning outcome classifier; the at least one storage device further comprising instructions executable by the at least one processor to: control execution by the cleaning machine of at least one cleaning process using the one or more predefined cleaning process parameters; monitor one or more cleaning process parameters during execution of the cleaning process; classify or score the outcome of the cleaning process using the trained cleaning process classifier based on the one or more cleaning process parameters monitored during execution of the cleaning process; and in response to the trained cleaning process classifier classifying the outcome of the cleaning process as soiled, adjusting one or more of the predefined cleaning process parameters such that a subsequent cleaning process will be classified as clean by the trained cleaning outcome classifier.

The trained cleaning process classifier may classify the outcome of the cleaning process as one of clean or soiled. The trained cleaning process classifier may score the outcome of the cleaning process by assigning a numerical score indicative of the cleaning outcome. The one or more cleaning cycle parameters may include one or more of a wash temperature, a rinse temperature, a wash time, a rinse time, a conductivity of the wash water, a detergent type, a rinse aid type, a water hardness of the wash water, an alkalinity of the wash water, and/or a measurement of food soil presence in the wash water. The measurement of food soil presence may be a Boolean parameter having a first possible value of food soil=true and a second possible value of food soil=false. The measurement of food soil presence may comprise a turbidity measurement of cleaning solution in a sump of the cleaning machine.

The trained cleaning outcome classifier may be one of a trained two-class classification machine learning model or a trained regression machine learning model. The at least one storage device may further comprise instructions executable by the at least one processor to control execution by the cleaning machine of a subsequent cleaning process using the adjusted one or more predefined cleaning process parameters. The trained cleaning outcome classifier may be trained using training data obtained from one or more designed experiments or field tests in which one or more cleaning process verification coupons are placed in a wash chamber of a cleaning machine and exposed to a cleaning process executed by the cleaning machine during a training phase. The trained cleaning outcome classifier may be trained based on one or more cleaning process parameters corresponding to each of a plurality of cleaning processes executed during a training phase and a known output corresponding to each of the plurality of cleaning processes executed during the training phase.

In another example, the disclosure is directed to a method comprising storing, in a storage device of an automated cleaning machine, one or more predefined cleaning process parameters and a trained cleaning outcome classifier; controlling, by a controller of the automated cleaning machine, execution by the cleaning machine of at least one cleaning process using the one or more predefined cleaning process parameters; monitoring, by the controller of the automated cleaning machine, one or more cleaning process parameters during execution of the cleaning process; classifying or scoring, by the controller of the automated cleaning machine, the outcome of the cleaning process using the trained cleaning process classifier based on the one or more cleaning process parameters monitored during execution of the cleaning process; and in response to the trained cleaning process classifier classifying the outcome of the cleaning process as soiled, adjusting, by the controller of the automated cleaning machine, one or more of the predefined cleaning process parameters such that a subsequent cleaning process will be classified as clean by the trained cleaning outcome classifier.

In another example, the disclosure is directed to an automated cleaning machine comprising at least one processor; at least one storage device that stores one or more predefined cleaning process parameters and a trained cleaning outcome classifier; the at least one storage device further comprising instructions executable by the at least one processor to: control execution by the cleaning machine of at least one cleaning process using the one or more predefined cleaning process parameters; monitor one or more cleaning process parameters during execution of the cleaning process; classify or score the outcome of the cleaning process using the trained cleaning process classifier based on the one or more cleaning process parameters monitored during execution of the cleaning process; in response to the trained cleaning process classifier classifying the outcome of the cleaning process as soiled, dynamically adjusting one or more of the predefined cleaning process parameters such that the cleaning process is classified as clean by the trained cleaning outcome classifier; and control execution by the cleaning machine of a remainder of the cleaning process using the dynamically adjusted one or more of the predefined cleaning process parameters.

The details of one or more examples are set forth in the accompanying drawings and the description below. Other features will be apparent from the description and drawings, and from the claims.

BRIEF DESCRIPTION OF DRAWINGS

FIG. 7 is a chart showing a summary of example classification model results for several binary classification model tools in accordance with the present disclosure.

FIG. 8 is a chart showing a summary of example classification model results for several regression model tools in accordance with the present disclosure.

DETAILED DESCRIPTION

Figure 1:
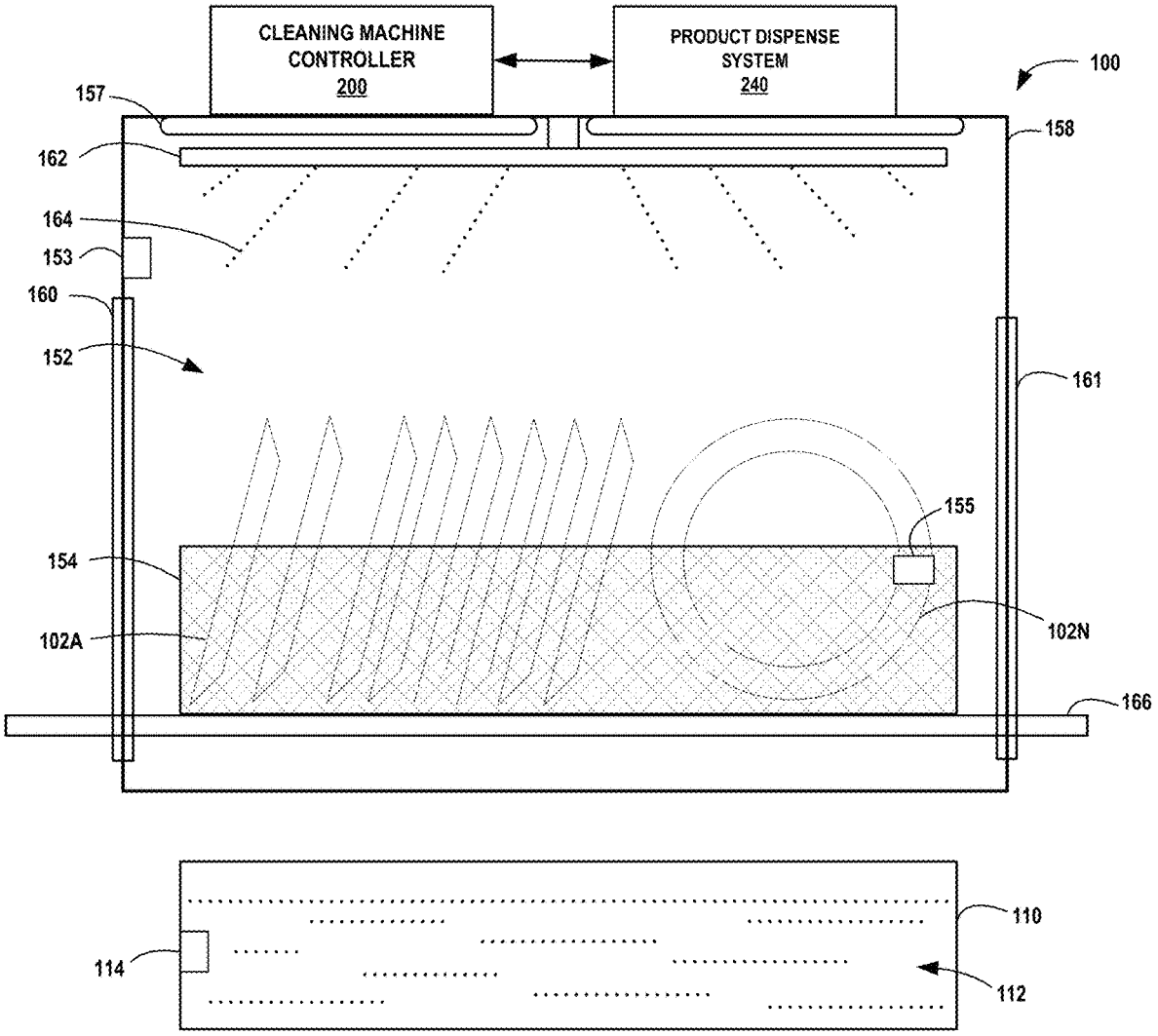
FIG. 1 shows an example automated cleaning machine that automatically classifies or scores cleaning outcomes for one or more cleaning processes executed by the cleaning machine using machine learning techniques in accordance with the present disclosure.

In general, the disclosure is directed to systems and/or methods of automatically classifying or scoring cleaning outcomes for a cleaning machine using machine learning techniques. For example, a cleaning outcome classifier may be trained on training data comprising a plurality of training inputs and a known output for each of the plurality of training inputs. Each of the plurality of training inputs may include one or more cleaning process parameters corresponding to a cleaning process executed by a cleaning machine during a training phase. The known output for each training input may include a cleaning outcome classification or score. The cleaning process parameters may include, for example, one or more of a wash temperature, a rinse temperature, a wash time, a rinse time, a conductivity of the wash water, a detergent type, a rinse aid type, a water hardness of the wash water, an alkalinity of the wash water, and/or a measurement of food soil presence in the wash water. The result of the training phase is a trained cleaning outcome classifier. The cleaning outcome of a novel cleaning process may be classified or scored with the trained cleaning outcome classifier based on one or more cleaning process parameters corresponding to the novel cleaning process.

The cleaning process parameters used to classify or score the outcome of a novel cleaning process may be the same as the cleaning process parameters used to train the cleaning outcome classifier during the training phase.

The training data may be obtained from one or more designed experiments and/or field tests in which one or more cleaning process verification coupons are placed in the wash chamber of a cleaning machine and exposed to a cleaning process executed by the cleaning machine. One or more cleaning process parameters are monitored during execution of the cleaning process, and one or more of these cleaning process parameters are used as training inputs to the cleaning outcome classifier.

Each verification coupon includes a substrate having at least one test indicator within a verification area of the substrate. The test indicator undergoes a change, such as complete removal, partial removal or a color change, when exposed to a cleaning process within the cleaning machine. The amount or degree of the change is a function of the efficacy of the cleaning process, and is used to assign a known output, such as a cleaning outcome classification or score, for each of the plurality of training inputs. In some examples, to quantify the amount or degree of change of the test indicator as a result of the cleaning process, color and/or grayscale sensor data is obtained from a reading of the verification area of the verification coupon. In some examples, a predefined color change threshold may be used to classify the known cleaning output as either "clean" or "soiled." In other examples, a range of defined color changes may be assigned a range of scores as the known output.

A cleaning outcome classifier may be trained on the training data comprising the plurality of training inputs obtained from the designed experiments and/or the field tests and the known output for each of the plurality of training inputs. The cleaning outcome classifier may include any type of machine learning tool, such as a classification tool or a regression tool. A classification-type cleaning outcome classifier may classify each of the plurality of training inputs into one of two categories for the known output, such as "clean" or "soiled." A regression-type cleaning outcome classifier may assign a numerical value or score for the known output (e.g., a number from 1 to 100). During the training phase, the cleaning outcome classifier utilizes the training data to find correlations among identified features of the training data (e.g., one or more of the cleaning process parameters) that affect the outcome. The result of the training phase is a trained cleaning outcome classifier.

The cleaning outcome of a novel cleaning process may then be classified or scored with the trained cleaning outcome classifier based on one or more cleaning process parameters corresponding to the novel cleaning process. For example, a controller of an automated cleaning machine may be programmed with the trained cleaning outcome classifier. One or more cleaning process parameters are monitored during execution of the novel cleaning process. One or more of the monitored cleaning process parameters monitored during the novel cleaning process may be used as inputs to the trained cleaning outcome classifier to classify or score the cleaning outcome of the novel cleaning process.

In some examples, the outcome of the trained cleaning outcome classifier may be used by the cleaning machine controller to automatically adjust one or more of the cleaning process parameters during a subsequent novel cleaning process to ensure a "clean" classification or a numerical score associated with a satisfactory cleaning outcome for the subsequent novel cleaning process.

FIG. 1 shows an example automated cleaning machine 100 that automatically classifies or scores cleaning outcomes for one or more cleaning processes executed by the cleaning machine 100 using machine learning techniques in accordance with the present disclosure.

In this example, cleaning machine 100 is a commercial door-type dish machine designed for cleaning and/or sanitizing eating and/or food preparation articles 102A-102N. In this example, articles 102A-102N are plates. It shall be understood, however, that articles 102A-102N may also include other eating or food preparation articles such as bowls, coffee cups, glassware, silverware, cooking utensils, pots and pans, etc. It shall further be understood that cleaning machine 100 may include any other type of cleaning machine such as clothes or textile washing machines, medical instrument re-processors, automated washer disinfectors, autoclaves, sterilizers, or any other type of cleaning machine, and that the disclosure is not limited with respect to the type of cleaning machine or to the types of articles to be cleaned.

Cleaning machine 100 includes an enclosure 158 defining one or more wash chamber(s) 152 and having one or more door(s) 160, 161 that permit entry and/or exit into wash chamber 152. One or more removable rack(s) 154 are sized to fit inside wash chamber 152. Each rack 154 may be configured to receive articles to be cleaned directly thereon, or they may be configured to receive one or more trays or holders into which articles to be cleaned are held during the cleaning process. The racks 154 may be general or special-purpose racks, and may be configured to hold large and/or small items, food processing/preparation equipment such as pots, pans, cooking utensils, etc., and/or glassware, dishes and other eating utensils, etc. In a hospital or healthcare application, the racks may be configured to hold instrument trays, hardgoods, medical devices, tubing, masks, basins, bowls, bed pans, or other medical items. It shall be understood that the configuration of racks 154, and the description of the items that may be placed on or in racks 154, as shown and described with respect to FIG. 1 and throughout this specification, are for example purposes only, and that the disclosure is not limited in this respect.

A typical cleaning machine such as cleaning machine 100 operates by spraying one or more cleaning solution(s) 164 (a mixture of water and one or more chemical cleaning products) into wash chamber 152 and thus onto the articles to be cleaned. The cleaning solution(s) are pumped to one or more spray arms 162, which spray the cleaning solution(s) 164 into wash chamber 152 at appropriate times. Cleaning machine 100 is provided with a source of fresh water and, depending upon the application, may also include one or more sumps, such as sump 110, to hold used wash and/or rinse solution 112 to be reused during the next cleaning cycle. Cleaning machine 100 may also include or be provided with a chemical product dispenser 240 that automatically dispenses the appropriate chemical product(s) at the appropriate time(s) during the cleaning process, mixes them with the diluent, and distributes the resulting cleaning solution(s) 164 to the cleaning machine 100 to be dispensed into the wash chamber 152. Depending upon the machine, the articles to be cleaned, the amount of soil on the articles to be cleaned, and other factors, one or more wash phases may be interspersed with one or more rinse phases and/or sanitization phases to form one complete cleaning process of cleaning machine 100.

Automated cleaning machine 100 further includes a cleaning machine controller 200. Controller 200 includes one or more processor(s) and/or processing circuitry that monitors and controls various cleaning process parameters of the cleaning machine 100 such as wash temperature, sump temperature, rinse temperature, wash and rinse times and sequences, cleaning solution concentrations, timing for dispensation of one or more chemical products, amounts of chemical products to be dispensed, timing for application of water and chemical products into the wash chamber, etc. Controller 200 may communicate with a product dispense system 240 in order to monitor and/or control the timing and/or amounts of cleaning products dispensed into cleaning machine 100.

Figure 4:
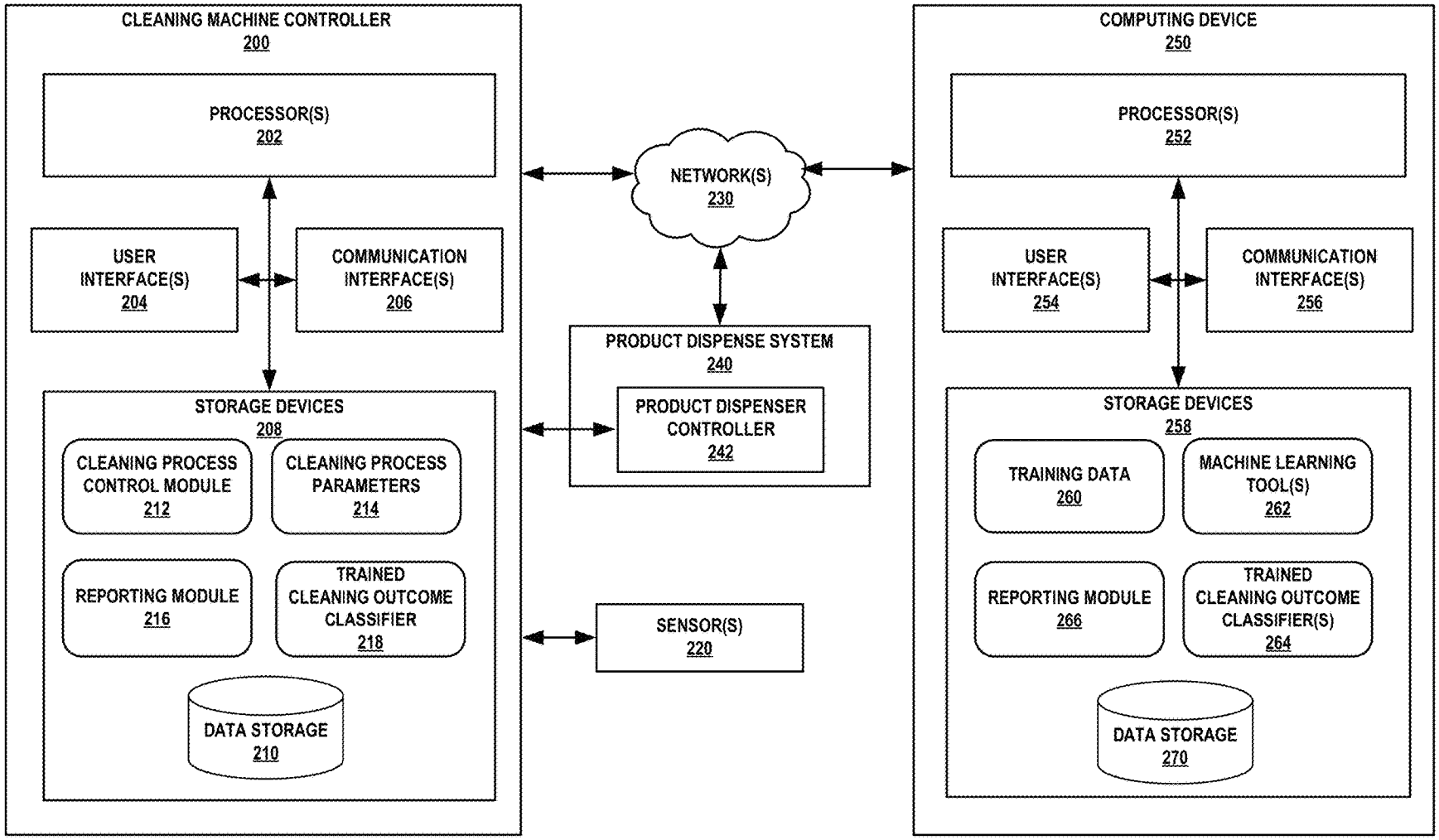
FIG. 4 is a block diagram of an example system in which an automated cleaning machine automatically classifies or scores cleaning outcomes for one or more cleaning processes executed by the cleaning machine using machine learning techniques in accordance with the present disclosure.

In some examples, cleaning machine controller 200 and/or product dispense system 240 may be configured to communicate with one or more remote computing devices or cloud-based server computing systems (see, e.g., FIG. 4). Cleaning machine controller 200 and/or product dispense system 240 may also be configured to communicate, either directly or remotely, with one or more user computing devices, such as tablet computers, mobile computing devices, smart phones, laptop computers, and the like.

As shown in FIG. 1, one or more articles to be cleaned, such as plates 102A-102N, may be placed on rack 154 and moved into the wash chamber 152 at the start of a cleaning process. Rack 154 may be moved on a conveyor 166 or other supporting structure. Cleaning machine 100 may include one or more sensors that monitor one or more cleaning process parameters during execution of each cleaning process. For example, cleaning machine 100 may include one or more temperature sensor(s) 153 that measure a temperature inside of the wash chamber 152. In the example of FIG. 1, temperature sensor 153 is positioned on a sidewall inside the wash chamber 152 of cleaning machine 100. Cleaning machine 100 may further include an incoming water supply temperature sensor 157 that measures a temperature of fresh rinse water delivered to the wash chamber of cleaning machine 100. Cleaning machine 100 may further include a sump temperature sensor 114 that measures a temperature of solution 112 in sump 110. For example, the sump water temperature may be measured at the start of a cleaning cycle, and at the end of the same cleaning cycle to determine a difference in the sump water temperature that occurred during the cleaning cycle. As another example, the sump water temperature may be measured or sampled continuously throughout the cleaning cycle, at periodic intervals or a predetermined times during the cleaning cycle. As another example, temperature sensor(s) (such as temperature sensor 155) may be located at one or more positions on a rack or on the base that holds the rack in the washing chamber to measure water temperature(s) at these position(s).

In accordance with the present disclosure, controller 200 of cleaning machine 100 automatically classifies or scores cleaning outcomes for one or more novel cleaning processes executed by the cleaning machine 100 using machine learning techniques in accordance with the present disclosure. For example, controller 200 of cleaning machine 100 may monitor one or more cleaning process parameters during execution of a novel cleaning process, and may classify or score the cleaning outcome of the novel cleaning process using a trained cleaning process classifier.

Controller 200 may use the cleaning outcome of the novel cleaning process to adjust one or more cleaning process parameters during subsequent novel cleaning processes to ensure that a "clean" cleaning outcome, or a score associated with a satisfactory cleaning outcome, is obtained for a subsequent novel cleaning process. For example, when the cleaning outcome of a novel cleaning process is classified as "soiled" or assigned a score associated with an unsatisfactory cleaning result, controller 200 may adjust one or more cleaning process parameters until the trained cleaning process classifier predicts a "clean" outcome or other cleaning score associated with a satisfactory cleaning outcome, and the adjusted cleaning process parameters may be used to ensure a satisfactory cleaning result during a subsequent novel cleaning process.

In another example, controller 200 may use a trained cleaning process classifier in order to dynamically adjust one or more cleaning process parameters of a current novel cleaning process to ensure a satisfactory cleaning outcome for the current novel cleaning process. Controller 200 may monitor one or more cleaning process parameters during execution of the current novel cleaning process. Controller 200 may, at one or more times during the current novel cleaning process and using a trained cleaning process classifier, predict the cleaning outcome of the current novel cleaning process based on the one or more monitored cleaning process parameters. Controller 200 may use the prediction to dynamically adjust one or more cleaning process parameters of the current novel cleaning process to ensure that a "clean" cleaning outcome, or a score associated with a satisfactory cleaning outcome, is obtained for the current novel cleaning process. For example, when the cleaning outcome of the current novel cleaning process is predicted to be "soiled" or assigned a score associated with an unsatisfactory cleaning result, controller 200 may dynamically adjust one or more cleaning process parameters during execution of the current cleaning process such that the trained cleaning process classifier predicts a "clean" outcome or other cleaning score associated with a satisfactory cleaning outcome for the current novel cleaning process. In this way, the number of cleaning processes having an unsatisfactory cleaning outcome may be reduced as the cleaning process parameters associated with the current cleaning process may be dynamically adjusted during execution of the current cleaning process itself to ensure that a satisfactory cleaning outcome is achieved.

In some examples, cleaning machine controller 200, or a remote computing system (see, e.g., FIG. 4) may generate one or more reports or notifications regarding the cleaning outcomes determined by the trained cleaning outcome classifier. For example, controller 200 may generate, based on the cleaning outcomes generated by the trained cleaning outcome classifier, a notification for display, such as display on a user computing device, which includes the cleaning outcome classification or score assigned to the cleaning process by the trained cleaning outcome classifier. The displayed data may further include one or more graphs or charts of the data monitored or generated with respect to the cleaning process.

Figure 2:
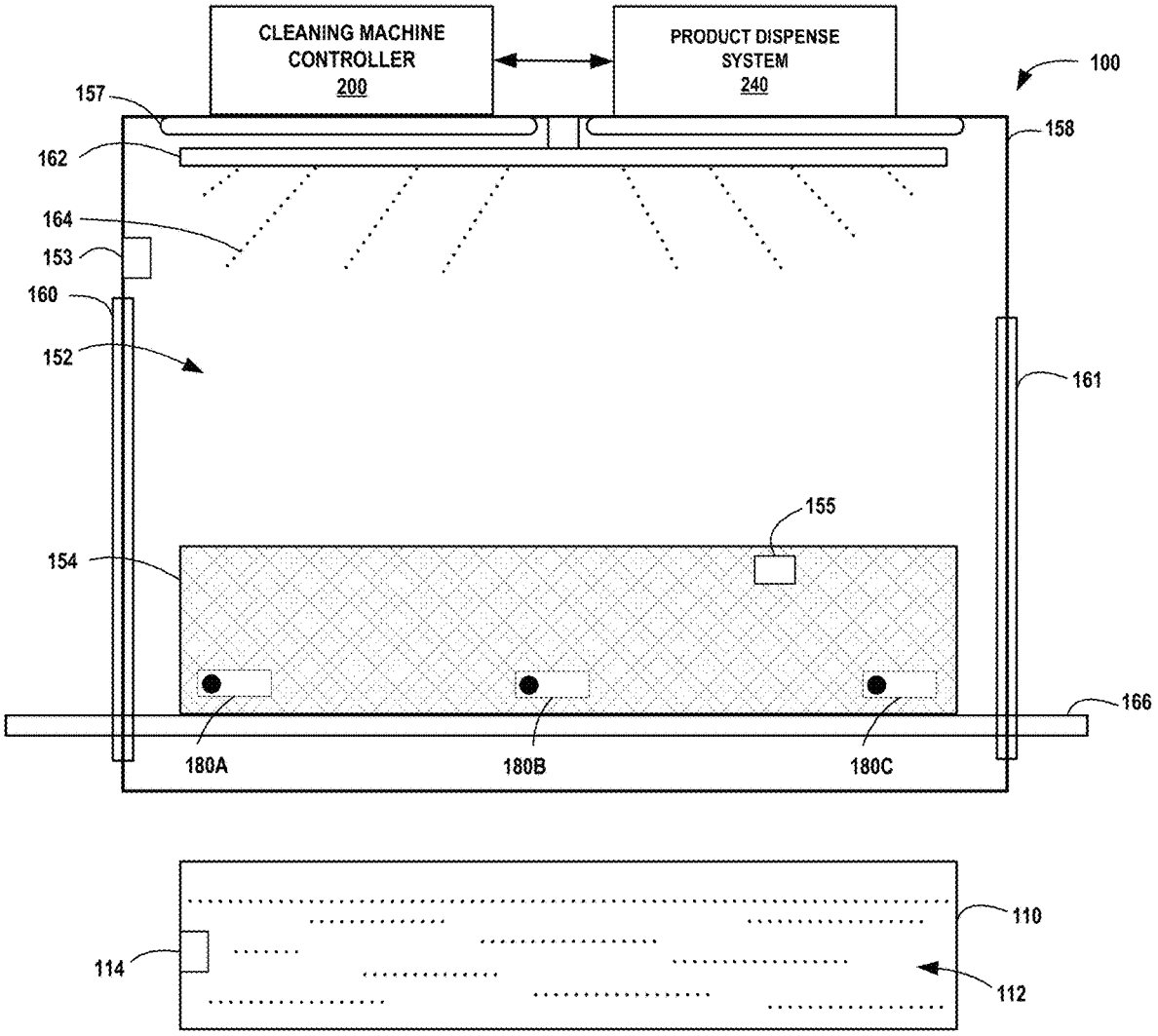
FIG. 2 shows an example automated cleaning machine including one or more cleaning process coupons used for generating training data for training a cleaning outcome classifier in accordance with the present disclosure.

FIG. 2 shows an example automated cleaning machine 100 of the type shown in FIG. 1 including one or more cleaning process coupons 180A-180C (referred to generally as verification coupon(s) 180) used for generating training data for training a cleaning outcome classifier in accordance with the present disclosure. The training data may be obtained during a training phase from one or more designed experiments and/or field tests in which one or more cleaning process verification coupons 180A-180C are placed in the wash chamber 152 of a cleaning machine 100 and exposed to a cleaning process executed by the cleaning machine 100. One or more cleaning process parameters are monitored during execution of the cleaning process, and one or more of these cleaning process parameters are used as training inputs to the cleaning outcome classifier. Although three verification coupons 180A-180C are shown in FIG. 2, it shall be understood that one or more cleaning verification coupon(s) 180 may be used, and that the verification coupon(s) 180 may be placed in varying locations within or on rack 154, and that the disclosure is not limited in this respect.

Figure 3A:
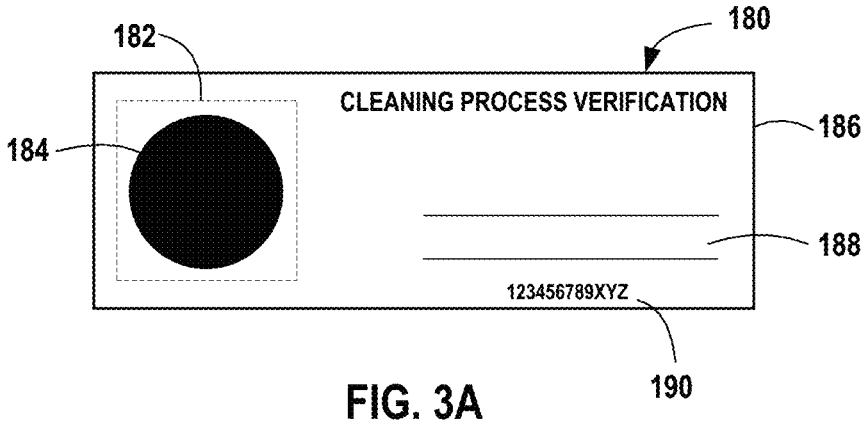
FIGS. 3A-3C show example cleaning process coupons corresponding to soiled, partially soiled, and clean, respectively, cleaning outcome classifications in accordance with the present disclosure.
Figure 3B:
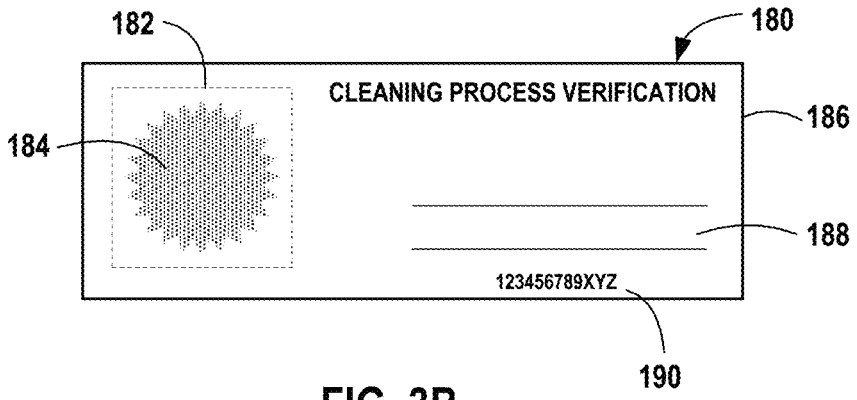
Figure 3C:
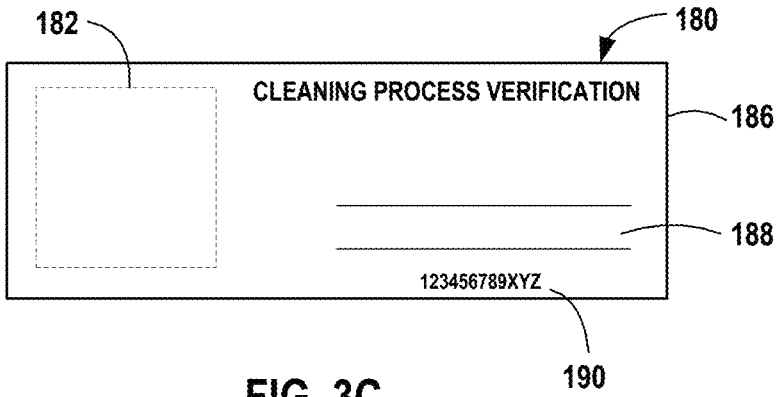

FIGS. 3A-3C show example cleaning process coupons 180 before exposure to a cleaning process (FIG. 3A), partially soiled after exposure to a cleaning process (FIG. 3B), and clean after exposure to a cleaning process (FIG. 3C). Verification coupon 180 includes a substrate 186 having a test indicator 184 within a verification area 182. The test indicator 184 undergoes a change, such as complete removal, partial removal or a color change, when exposed to a cleaning process within the cleaning machine. For example, FIG. 3B shows the example cleaning process verification coupon 180 of FIG. 3A in which test indicator 182 has been partially removed by a cleaning process, and FIG. 3C shows the example cleaning process verification coupon 180 of FIG. 3A in which test indicator 182 has been completely removed by a cleaning process.

The test indicator may include a single indicative soil, such as shown in FIGS. 3A-3C, or may include multiple indicative soils. For example, the test indicator may include more than one type of soil within the verification area 182, and/or may include more than one soil level of a single type of soil within the verification area 182. The type of cleaning process coupon 180 and/or the type of test indicator 184 to be used may depend upon, for example, one or more of the particular application or customer, the type of cleaning machine, the wares to be cleaned, the type of soil(s) likely to be encountered in that application, etc.

The amount or degree of the change is a function of the efficacy of the cleaning process, and is used to assign a known output, such as a cleaning outcome classification or score, for each cleaning process executed during a training phase. To quantify the amount or degree of change of the test indicator as a result of the cleaning process, color and/or grayscale sensor data may be obtained from a reading of the verification area of the verification coupon. In some examples, a predefined threshold may be used to classify the known cleaning output as either "clean" or "soiled." In other examples, a range of defined color changes may be assigned a range of scores as the known cleaning output.

Substrate 186 may include any type of temperature stable material such as plastics, papers, metals, or ceramics. Examples of suitable substrate materials include, but are not limited to, polyethylene, polypropylene, polyester, polyvinyl chloride (vinyl), high density polyethylene (HDPE), polyethylene terephthalate (PET), and synthetic forms of paper, plastics, ceramics, stainless steel and other metals. Test indicator 184 may be printed, ink-jet printed, screen printed, spray coated, dip coated, or otherwise deposited on substrate 186.

Verification coupon 180 may also include one or more other areas, such as a writable area 188, which allows a user to add identification information or other notes to verification coupon 180. The identification information may include, for example, the date and time of the cleaning cycle, identification of the cleaning machine, identification of the person running the cleaning cycle and/or the verification procedure, a "clean" or "soiled" indication, and/or other information relevant to the cleaning process verification procedure. The verification coupon 180 may further include a printed identifier 190 uniquely identifying the coupon. In the example of FIGS. 3A-3C, identifier 190 is a serial number visually readable by a human being, and/or electronically readable by a computing device. In other examples, identifier 190 may also include one or more of a bar code, a QR code, or other type of electronically readable identifier or code.

Each verification coupon 180 and test indicator 184 is designed to represent soils experienced in a particular application and to be responsive to cleaning process(es) appropriate for those applications. For example, in a restaurant or other food establishment, the automated cleaning machines may include automated dish machines and the cleaning processes may be expected to remove food and/or other soils typically encountered in such applications. The test indicator(s) designed for such applications may therefore include food-based soil(s) such as fats and oils, proteins, carbohydrates, food dyes, minerals, starches, coffee and tea stains, etc., or other soils commonly encountered in a food establishment such as dyes, inks, lipstick or other cosmetic soils. In a healthcare application, the test indicator(s) may include those typically found or representative of those encountered in a medical environment), which may further include organic soils such as protein, lipids, carbohydrates, bone chips, etc., and/or inorganic soils such as saline, simethicone, bone cement, calcium and other minerals, dyes, inks, etc. In other applications, the test indicator(s) may include those soils or stains typically found or representative of those encountered in such applications, and the disclosure is not limited in this respect.

Figure 3D:
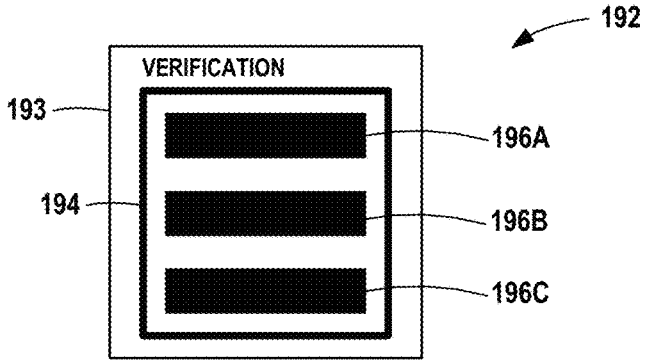
FIGS. 3D-3F show another example cleaning process coupon corresponding to soiled, partially soiled and clean, respectively, cleaning outcome classifications in accordance with the present disclosure.
Figure 3E:
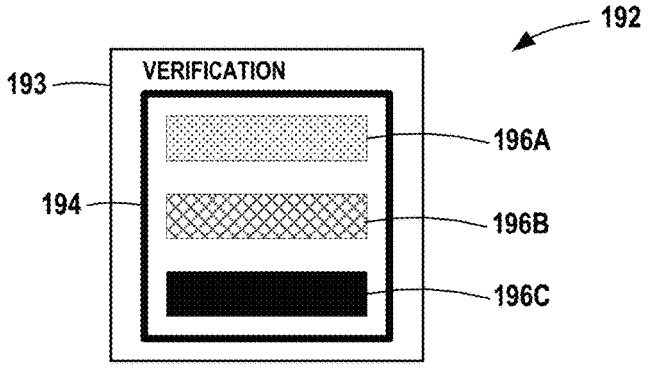
Figure 3F:
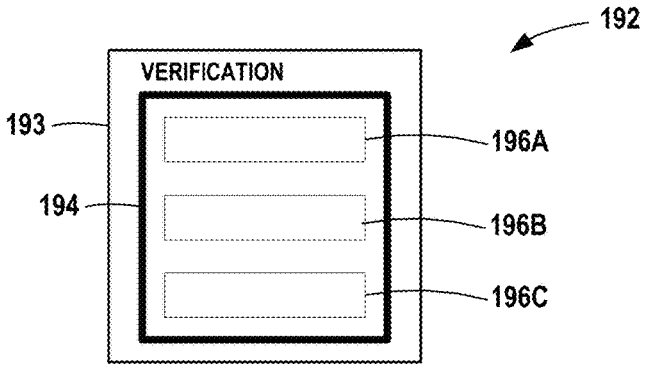

FIGS. 3D-3F show another example cleaning process coupon 192 corresponding to soiled, partially soiled and clean, respectively, cleaning outcome classifications in accordance with the present disclosure. In this example, verification coupon 192 includes a substrate 193 having three test indicators 196A-196C within a verification area 194. Test indicators 196A-196C are comprised of three unique engineered soils with varying degrees of removal difficulty. The difference(s) between the test indicators 196A-196C may include, for example, the color of the engineered soil, the size and/or the geometry of the soil spot, and/or the composition of the engineered soil. Verification coupon 192 thus provides three unique challenges to a cleaning process. The test indicators 196A-196C undergo a change, such as complete removal, partial removal or a color change, when exposed to a cleaning process within the cleaning machine. The type of cleaning process coupon 192 and/or the number and/or type of test indicators 196A-196C to be used may depend upon, for example, one or more of the particular application or customer, the type of cleaning machine, the wares to be cleaned, the type of soil(s) likely to be encountered in that application, etc. Although verification coupon 192 is shown and described as including three unique soils, it shall be understood that verification coupon may include a single soil, two unique soils, or three or more unique soils, and that the disclosure is not limited in this respect. It shall further be understood that example verification coupon 192, or any other variation of a verification coupon, may be substituted for or used in combination with example verification coupon 180 in a cleaning machine as shown in FIG. 2 or as otherwise described herein.

FIGS. 3D-3F show an example cleaning process coupon 192 before exposure to a cleaning process (FIG. 3D), partially soiled after exposure to a cleaning process (FIG. 3E), and clean after exposure to a cleaning process (FIG. 3F). For example, FIG. 3E shows the example cleaning process verification coupon 192 of FIG. 3D in which test indicators 196A, 196B, and 196C have been partially removed by a cleaning process, but removed to different degrees due to their differing soil types and/or differing degrees of removal difficulty. FIG. 3F shows the example cleaning process verification coupon 192 of FIG. 3A in which each of test indicators 196A-196C have been completely removed by a cleaning process.

The amount or degree of the change is a function of the efficacy of the cleaning process, and is used to assign a known output, such as a cleaning outcome classification or score, for each cleaning process executed during a training phase. To quantify the amount or degree of change of the test indicator as a result of the cleaning process, color and/or grayscale sensor data may be obtained from a reading of the verification area of the verification coupon. In some examples, a predefined threshold may be used to classify the known cleaning output as either "clean" or "soiled." In other examples, a range of defined color changes may be assigned a range of scores as the known cleaning output.

Substrate 193 may include any type of temperature stable material such as plastics, papers, metals, or ceramics. Examples of suitable substrate materials include, but are not limited to, polyethylene, polypropylene, polyester, polyvinyl chloride (vinyl), high density polyethylene (HDPE), polyethylene terephthalate (PET), and synthetic forms of paper, plastics, ceramics, stainless steel and other metals. Test indicators 196A-196C may be printed, ink-jet printed, screen printed, spray coated, dip coated, or otherwise deposited on substrate 193. Test indicators 196A-196C may be deposited on substrate 193 using the same manufacturing techniques or different manufacturing techniques.

Verification coupon 192 may also include one or more other areas, such as a writable area which allows a user to add identification information or other notes to verification coupon 192. The writable area may be on the front side of verification coupon 192, or may be on the back side of verification coupon 92 (not shown). The identification information may include, for example, the date and time of the cleaning cycle, identification of the cleaning machine, identification of the person running the cleaning cycle and/or the verification procedure, a "clean" or "soiled" indication, and/or other information relevant to the cleaning process verification procedure. The verification coupon 192 may further include a printed identifier uniquely identifying the coupon. For example, similar to the identifier 190 of FIGS. 3A-3C, coupon 192 may also include identifier such as a serial number visually readable by a human being, and/or electronically readable by a computing device. In other examples, similar to that described with respect to FIGS. 3A-3C, the identifier may also include one or more of a bar code, a QR code, or other type of electronically readable identifier or code.

Each verification coupon 192 and test indicators 196A-196C are designed to represent soils experienced in a particular application and to be responsive to cleaning process(es) appropriate for those applications. For example, in a restaurant or other food establishment, the automated cleaning machines may include automated dish machines and the cleaning processes may be expected to remove food and/or other soils typically encountered in such applications. The test indicator(s) designed for such applications may therefore include food-based soil(s) such as fats and oils, proteins, carbohydrates, food dyes, minerals, starches, coffee and tea stains, etc., or other soils commonly encountered in a food establishment such as dyes, inks, lipstick or other cosmetic soils. In a healthcare application, the test indicator (s) may include those typically found or representative of those encountered in a medical environment), which may further include organic soils such as protein, lipids, carbohydrates, bone chips, etc., and/or inorganic soils such as saline, simethicone, bone cement, calcium and other minerals, dyes, inks, etc. In other applications, the test indicator(s) may include those soils or stains typically found or representative of those encountered in such applications, and the disclosure is not limited in this respect. For verification coupon 192, the three unique test indicators 196A-196C may include any three different types of soil challenges appropriate for the application.

Referring again to FIG. 2, one or more cleaning process parameters are monitored during execution of each cleaning process during the training phase. Once cleaning machine has completed execution of a cleaning process during the training phase, the verification coupon(s), such as verification coupon(s) 180, 192, or other type of verification coupon associated with the cleaning process, are removed from the cleaning machine 150. The one or more of the cleaning process parameters monitored during execution of the cleaning process form a training input to a cleaning outcome classifier. The amount of soil remaining on the verification coupon(s) are indicative of the efficacy of the cleaning process. The amount of soil remaining on the verification coupon(s) may be quantified to assign a known output for each training input.

In one example, in order to quantify the amount of soil remaining on a verification coupon(s) 180, 192 or other example verification coupon, after completion of a cleaning process, a color sensor may be used to obtain color reading(s) associated with the verification area (e.g., verification area 182 of the coupon 180 or verification area 194 of verification coupon 192). The color reading(s) may be transmitted to and received by a computing device (see, e.g., FIG. 4), which may analyze the color reading(s) to generate additional color data. The color data may include, for example, one or more RGB ratios. The RGB ratios may include, for example, a red/green ratio (R/G), a red/blue ratio (R/B), and/or a blue/green (B/G) ratio. In addition, or alternatively, the color data may include one or more percent color values. The percent color values may include, for example, a percent red (% R), a percent blue (% B), and/or a percent green (% G). The color data may further include a FIJI gray value. Other color data may also be generated, and the disclosure is not limited in this respect. For a verification coupon such as coupon 192 having one or more test indicators, such as test indicators 196A-196C within a verification area 194, the color data may include separate color data associated with each of the test indicators 196A-196C within the verification area 194.

In some examples, the test indicator(s) may be stained or dyed to bring about a color change if certain soils remain, such as proteins (Coomassie blue or silver staining methods), carbohydrates, fats, blood, etc. Staining or dying of the test indicator may help to make certain changes in the test indicator more easily detectable under certain situations.

Example techniques for quantifying the amount of soil remaining on a verification coupon after completion of a cleaning process are described in U.S. Provisional Application No. 62/942,801, filed Dec. 3, 2019, and entitled, "Verification of Cleaning Process Efficacy," which is incorporated herein by reference in its entirety. However, it shall be understood that other techniques for quantifying the amount of soil remaining on a verification coupon may also be used, and that the disclosure is not limited in this respect. In one alternative example, the amount of soil remaining, or whether a verification coupon should be classified as "clean" or "soiled," may be determined manually by visual inspection.

It shall further be understood that other cleaning process verification techniques for determining efficacy of a cleaning process may be substituted for the cleaning process verification coupons described herein, and such alternative cleaning process verification techniques may be used to train machine learning models for classifying or scoring cleaning outcomes as described herein, and that the disclosure is not limited this respect. For example, a grading system based on visual inspection of the wares or the verification coupons, measurements of residual bacterial growth, protein staining, ATP swabbing and measurements of bioluminescence to detect residual ATP as an indicator of surface cleanliness, etc., may also be used to determine and/or measure efficacy of a cleaning process.

To assign a known cleaning output to each cleaning process, in some examples, a predefined color change threshold may be used to classify the known cleaning output as either "clean" or "soiled." In other examples, a range of defined color changes may be assigned a range of scores as the known cleaning output. For example, the example verification coupons in FIGS. 3A and 3B would be classified as "soiled" while the example coupon of FIG. 3C would be classified as "clean." As another example, the example verification coupon 192 in FIGS. 3D and 3E may be classified as "soiled" (that is, one of a Boolean value of either clean or soiled) or as varying levels of "soiled," (e.g., a score from 1-5 wherein 1 is least soiled and 5 is most soiled, or some other user defined scoring method) while the example coupon 192 of FIG. 3F may be classified as "clean."

A cleaning outcome classifier may be trained on the training data comprising the plurality of training inputs obtained from the designed experiments and/or the field tests and the known output for each of the plurality of training inputs. The cleaning outcome classifier may include any type of machine learning tool, such as a classification tool or a regression tool. A classification tool may classify each of the plurality of training inputs into one of several categories for the known output, such as "clean" or "soiled." A regression tool may quantify each of the plurality of training inputs into a value or score for the known output (e.g., a number from 1 to 100). The cleaning outcome classifier utilizes the training data to find correlations among identified features of the training data (e.g., one or more of the cleaning process parameters) that affect the outcome.

The cleaning outcome of a novel cleaning process may then be classified or scored with the trained cleaning outcome classifier based on one or more cleaning process parameters corresponding to the novel cleaning process. For example, a controller of an automated cleaning machine (such as cleaning machine 100 of FIG. 1) may be programmed with the trained cleaning outcome classifier. One or more cleaning process parameters are monitored during execution of the novel cleaning process. The one or more cleaning process parameters monitored during the novel cleaning process are used as inputs to the trained cleaning outcome classifier to classify or score the novel cleaning process.

In addition, in some examples, the outcome of the trained cleaning outcome classifier may be used by the cleaning machine controller to automatically adjust one or more of the cleaning process parameters during a subsequent novel cleaning process to ensure a "clean" classification or a numerical score associated with a satisfactory cleaning outcome for the subsequent novel cleaning process.

FIG. 4 is a block diagram showing an example cleaning machine controller 200 that automatically classifies or scores cleaning outcomes for one or more novel cleaning processes executed by an associated cleaning machine (such as cleaning machine 100 as shown in FIG. 1) using machine learning techniques in accordance with the present disclosure. For example, controller 200 includes a trained cleaning outcome classifier 218 that classifies or scores cleaning outcomes for one or more novel cleaning processes executed by an associated cleaning machine.

Cleaning machine controller 200 is a computing device that includes one or more processors 202, one or more user interface components 204, one or more communication components 206, and one or more data storage components 210. User interface components 204 may include one or more of audio interface(s), visual interface(s), and touch-based interface components, including a touch-sensitive screen, display, speakers, buttons, keypad, stylus, mouse, or other mechanism that allows a person to interact with a computing device. Communication components 206 allow controller 200 to communicate with other electronic devices, such as a product dispenser controller 242 and/or other remote or local computing devices 250. The communication may be accomplished through wired and/or wireless communications, as indicated generally by network(s) 230.

Controller 200 includes one or more storage device(s) 208 that include a cleaning process control module 212, stored cleaning cycle parameters 214, a trained cleaning outcome classifier 218, an analysis/reporting module 216 and data storage 210. Modules 212, 216 and/or 218 may perform operations described using software, hardware, firmware, or a mixture of hardware, software, and firmware and/or other processing circuitry residing in and/or executing at controller 200. Controller 200 may execute modules 212, 216 and/or 218 with one or more processors 202. Controller 200 may execute modules 212, 216 and/or 218 as a virtual machine executing on underlying hardware. Modules 212, 216 and/or 218 may execute as a service or component of an operating system or computing platform, such as by one or more remote computing devices 250. Modules 212, 216 and/or 218 may execute as one or more executable programs at an application layer of a computing platform. User interface 204 and modules 212, 216 and/or 218 may be otherwise arranged remotely to and remotely accessible to controller 200, for instance, as one or more network services operating in a network cloud-based computing system provided by one or more of remote computing devices 250.

Cleaning cycle parameters 214 includes cleaning process parameters for one or more default cleaning cycles, such as "normal", "pots/pans", "heavy duty", etc. The cleaning process parameters may include, for example, wash and rinse phase timing and sequencing, wash and rinse water temperatures, sump water temperatures, wash and rinse water conductivities, wash phase duration, rinse phase duration, dwell time duration, wash and rinse water pH, detergent concentration, rinse agent concentration, humidity, water hardness, turbidity, rack temperatures, mechanical action within the cleaning machine, and any other cleaning process parameter that may influence the efficacy of the cleaning process. The values for one or more cleaning process parameters may be different for each type of cleaning cycle. For example, the cleaning process parameters for the "heavy duty" cleaning cycle may include one or more of higher wash water temperatures, higher rinse water temperatures, longer wash times, larger amounts of cleaning products, or other different cleaning cycle parameters as compared to the "normal" cleaning cycle. The cleaning process parameters may be different depending upon the type of machine, for example, door type machines and conveyor type machines may have different cleaning process parameters.

Cleaning process control module 212 includes instructions that are executable by processor(s) 202 to perform various tasks. For example, cleaning process control module 212 includes instructions that are executable by processor(s) 202 to initiate and/or control one or more novel cleaning processes in an associated cleaning machine. Controller 200 further monitors one or more cleaning process parameters during execution of the cleaning process. Cycle data corresponding to each cleaning process executed by the cleaning machine, including one or more cleaning process parameters monitored during execution of the cleaning process or otherwise corresponding to the cleaning process, may be stored in data storage 210.

In accordance with the present disclosure, trained cleaning outcome classifier 218 includes instructions that are executable by processor(s) 202 to automatically classify or score cleaning outcomes for the cleaning processes executed by the associated cleaning machine (such as cleaning machine 100 as shown in FIG. 1) using machine learning techniques in accordance with the present disclosure. For example, the cleaning outcome of a novel cleaning process executed by the cleaning machine may then be classified or scored with the trained cleaning outcome classifier 218 based on one or more cleaning process parameters monitored during the novel cleaning process or otherwise associated with the novel cleaning process.

Analysis/reporting module 216 (or any of cleaning process control module 212, or other software or module stored in storage devices 208) may generate one or more notifications or reports for storage or for display on user interface 204 of controller 200, or on any other local or remote computing device 250, regarding the cleaning outcomes for each of the one or more novel cleaning cycles.

As another example, the reports may include data associated with cleaning processes executed at a particular cleaning machine, a group of one or more cleaning machines, cleaning machines at a particular location or group of locations, cleaning machines associated with a particular corporate entity or group of entities, etc. The reports may further include data associated with cleaning processes executed by date(s)/time(s), by employee, etc. The data may be used to identify trends, areas for improvement, or otherwise assist the organizational person(s) responsible for ensuring the efficacy of cleaning cycles to identify and address problems with the cleaning machines.

The report(s) may include information monitored during one or more cleaning processes, and the data for each cleaning process may include information monitored during execution of the cleaning process such as the date and time of the cleaning process, a unique identification of the cleaning machine, a unique identification of the person running the cleaning process, an article type cleaned during the cleaning process, a rack volume or types of racks or trays used during the cleaning process, wash phase duration, rinse phase duration, dwell duration, wash and rinse water temperatures, sump water temperatures, wash and rinse water conductivities, wash and rinse water pH, detergent concentration, rinse agent concentration, environmental humidity, water hardness, turbidity, presence/absence of food soil in the sump, rack temperatures, the types and amounts of chemical product dispensed during each cycle of the cleaning process, the volume of water dispensed during each cycle of the cleaning process, the total number of heat unit equivalents (HUEs) accumulated over the course of the cleaning cycle or other information relevant to the cleaning process. The report(s) may also include information concerning the location; the business entity/enterprise; corporate clean verification targets and tolerances; cleaning scores by location, region, machine type, date/time, employee, and/or cleaning chemical types; energy costs; chemical product costs; water consumption; and/or any other cleaning cycle data collected or generated by the system or requested by a user.

Figure 5:
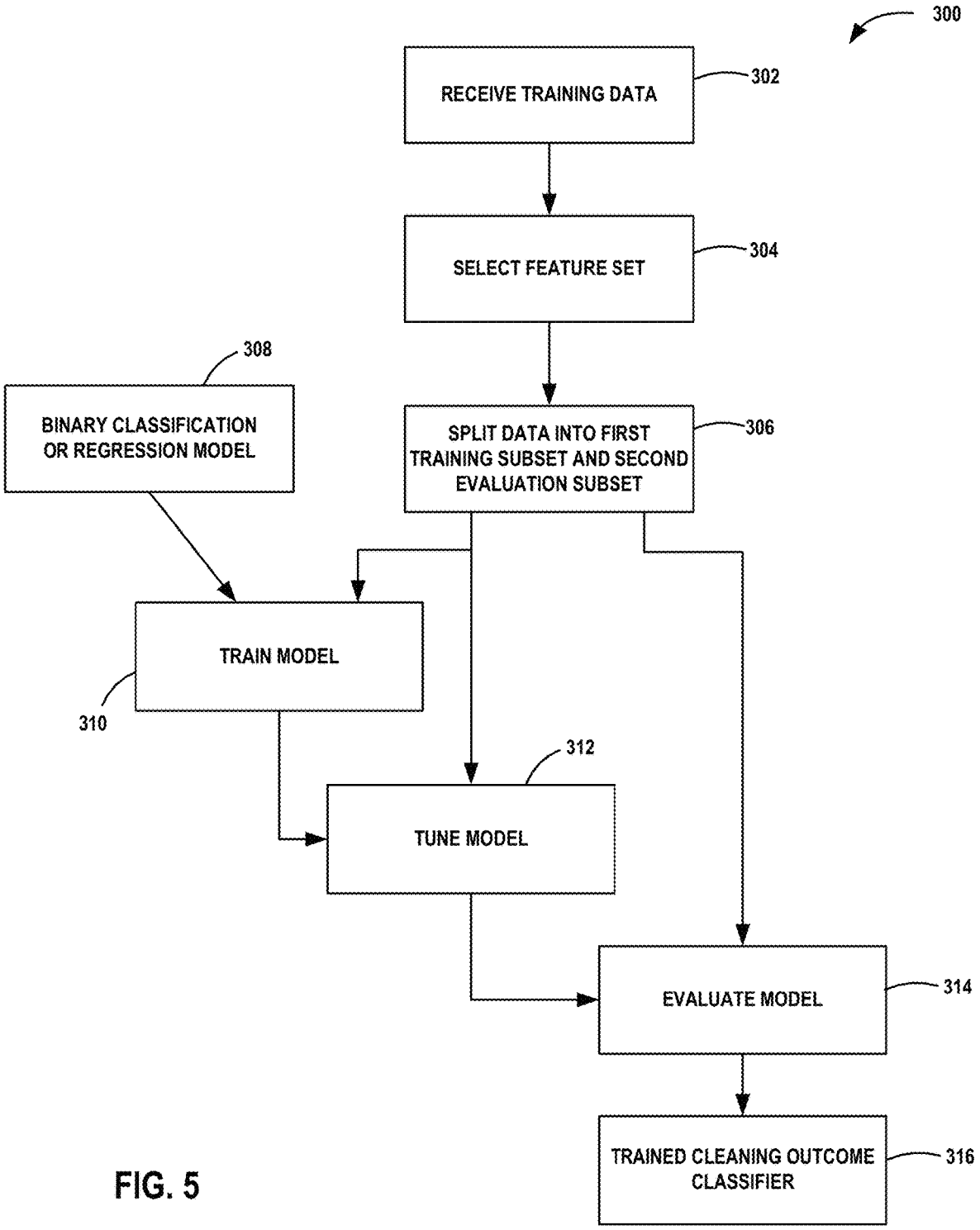
FIG. 5 is a flowchart illustrating an example process by which a computing device trains a cleaning outcome classifier in accordance with the present disclosure.

FIG. 5 is a flowchart illustrating an example process (300) for a training phase in which a computing device trains a cleaning outcome classifier during a training phase in accordance with the present disclosure. The computing device may include, for example, any one of example computing device(s) 250 of FIG. 4, and the process (300) may be controlled at least in part based on execution of instructions stored in machine learning tool(s) and executed by processor(s) 252.

In this example, a cleaning outcome classifier is trained on training data comprising a plurality of training inputs and a known output for each of the plurality of training inputs. Each of the plurality of training inputs corresponds to a cleaning process executed by a cleaning machine during a training phase. The cleaning processes executed during the training phase may be executed by one or more cleaning machines. The known output for each training input may include a cleaning outcome classification or score. Each of the training inputs corresponding to a cleaning process executed during the training phase may include, for example, one or more cleaning process parameters monitored during execution of the cleaning process or otherwise corresponding to the cleaning process. The cleaning process parameters may include, for example, one or more of a wash temperature, a rinse temperature, a wash time, a rinse time, a conductivity of the wash water, a detergent type, a rinse aid type, a water hardness of the wash water, an alkalinity of the wash water, and/or a measurement of food soil presence in the wash water. The result of the training phase is a trained cleaning outcome classifier that classifies or scores the cleaning outcome of a novel cleaning process based on one or more cleaning process parameters monitored during the novel cleaning process or otherwise corresponding to the novel cleaning process.

At the start of the process (300) the computing device receives the training data (302). The training data includes a plurality of training inputs, wherein each of the plurality of training inputs has a corresponding known training output. Each of the plurality of training inputs and corresponding known training output is associated with a different one of a plurality of cleaning processes executed by one or more cleaning machines during a training phase. The training data may be obtained from one or more designed experiments and/or field tests in which one or more cleaning process verification coupons (or other mechanism for verification of cleaning process efficacy) are placed in the wash chamber of a cleaning machine and exposed to a cleaning process executed by the cleaning machine. One or more cleaning process parameters are monitored during execution of the cleaning process during the training phase, and a subset of the one or more of these cleaning process parameters are used as training inputs to the cleaning outcome classifier.

The known training output may be, for example, a binary classification (e.g., "clean" or "soiled"). In other examples, the known training output may be a quantified or numeric score (e.g., a score from 0-100 or some other numeric range) indicative of the relative amount of soil remaining on the verification coupon, and thus indicative of the relative efficacy of the cleaning process.

At step (304) a "feature set" of the one or more cleaning process parameters on which the cleaning outcome classifier is to be trained is selected. For example, based on analysis performed on the training data using one or more machine learning tools in accordance with the present disclosure, one or more of the cleaning process parameters may be identified as being relatively more important to prediction of the cleaning outcome than others. In addition, certain combinations of the one or more cleaning process parameters may be identified as being relatively more important to prediction of the cleaning outcome. The selection of the feature sets may also be based on which cleaning process parameters were measured or available. Examples of different feature sets of cleaning process parameters are shown in Table 1:

TABLE 1

| Feature Set A: Machine | Feature Set B: Machine + Product | Feature Set C: Machine + Product + Manual Tests | Feature Set D: Machine + Product + Manual Tests + Food Soil |
|---|---|---|---|
| Wash Temp | Wash Temp | Wash Temp | Wash Temp |
| Rinse Temp | Rinse Temp | Rinse Temp | Rinse Temp |
| Wash Time | Wash Time | Wash Time | Wash Time |
| Rinse Time | Rinse Time | Rinse Time | Rinse Time |
| Conductivity | Conductivity | Conductivity | Conductivity |
| | Detergent Type | Detergent Type | Detergent Type |
| | Rinse Aid Type | Rinse Aid Type | Rinse Aid Type |
| | | Water Hardness | Water Hardness |
| | | Titration | Titration |
| | | Alkalinity | Alkalinity |
| | | Titration (drops) | Titration (drops) |
| | | | Food Soil |

Once the cleaning process parameters to be used as inputs to the cleaning outcome classifier are selected (304), the selected training data is divided into a first subset of training data to be used for training the cleaning outcome classifier and a second subset of training data to be used for evaluating the trained cleaning outcome classifier generated based on the first subset of training data (306).

The cleaning outcome classifier may be implemented using any type of machine learning algorithm or tool, such as a binary classification model or a regression model (308). Examples of different machine-learning tools include Logistic Regression (LR), Linear Regression, Boosted Decision Tree, Bayes Point Machine, Naive-Bayes, Random Forest (RF), neural networks (NN), and Support Vector Machines (SVM) tools. In some examples, the tools may be implemented as two-class binary classification models (e.g., "clean" or "soiled") or regression models which generate a quantified numeric score indicative of the relative amount of soil remaining on the verification coupon, and thus indicative of the relative efficacy of the cleaning process.

The machine-learning algorithm or tool (308) utilizes the first subset of the training data (306) to find correlations among the identified features (e.g., the one or more cleaning process parameters) that affect the corresponding known cleaning outcome. In other words, the machine learning tool trains the cleaning outcome classifier with the first subset of the training data (310). The machine learning model is tuned (312), also using the first subset of the training data, to improve or maximize the model's performance. The machine-learning tool uses the second subset of the training data in order to appraise or score how well the cleaning outcome classifier is able to predict the cleaning outcomes. The result of the training is the trained cleaning outcome classifier (316).

Figure 9:
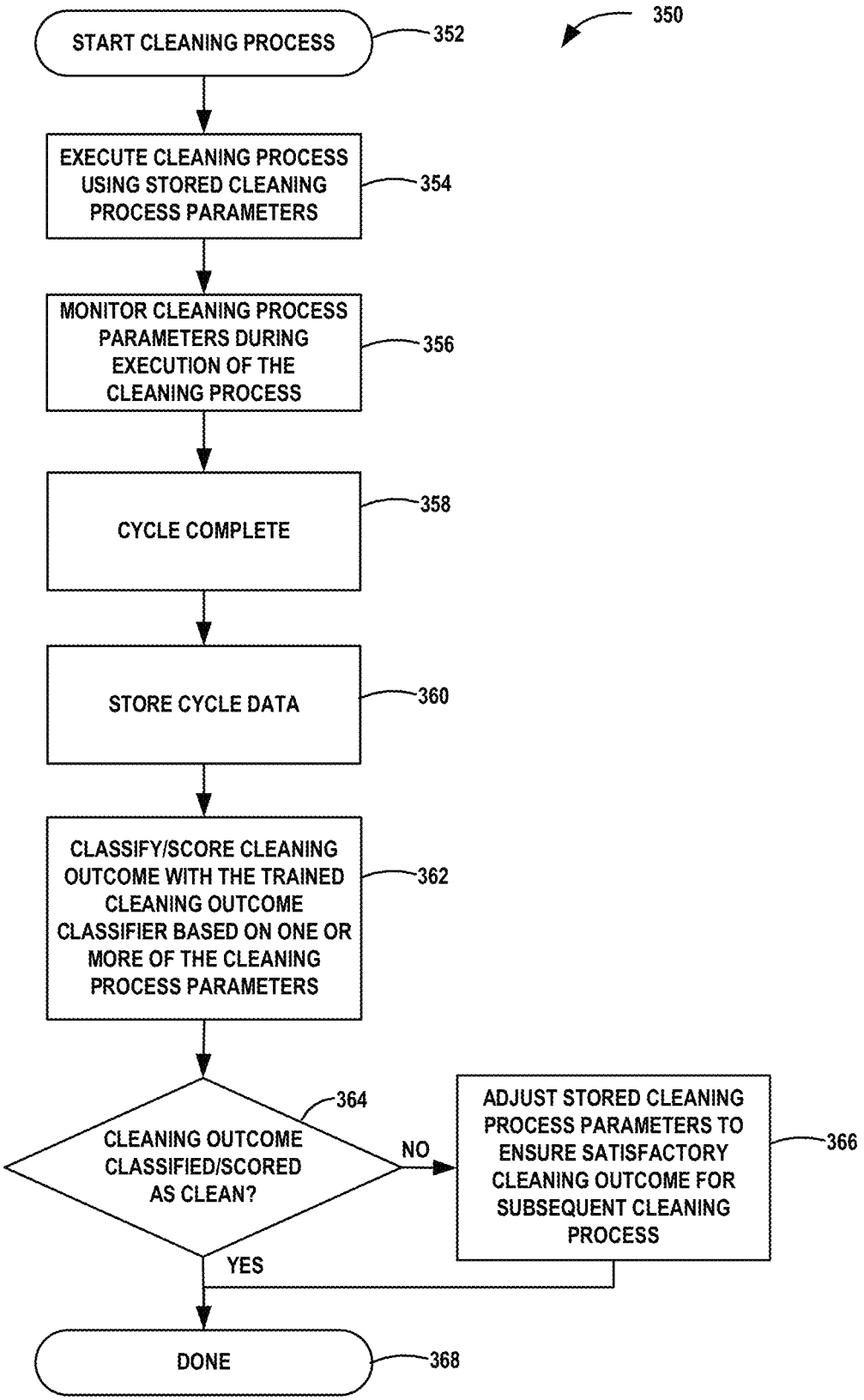
FIG. 9 is a flowchart illustrating an example process by which a computing device classifies an outcome of a cleaning process executed by a cleaning machine with a trained cleaning outcome classifier in accordance with the present disclosure.

The cleaning outcome classifier (316) may be used to perform an assessment of one or more novel cleaning processes as shown and described herein with respect to FIG. 9.

Figure 6A:
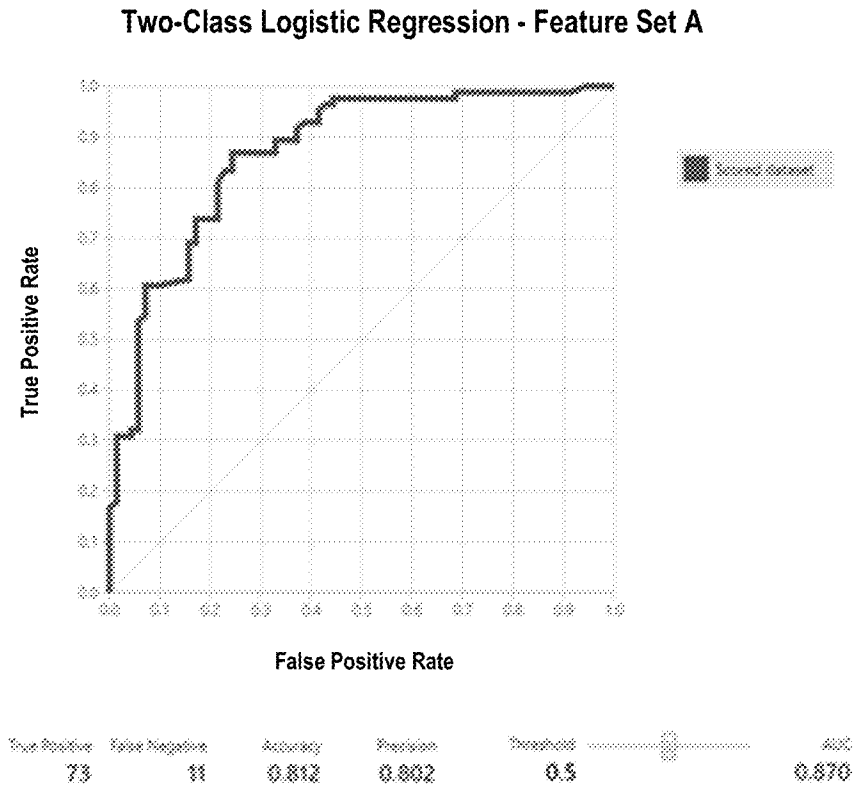
FIGS. 6A-6C are graphs illustrating example results obtained from evaluation of different binary cleaning outcome classifiers and using different feature sets.
Figure 6B:
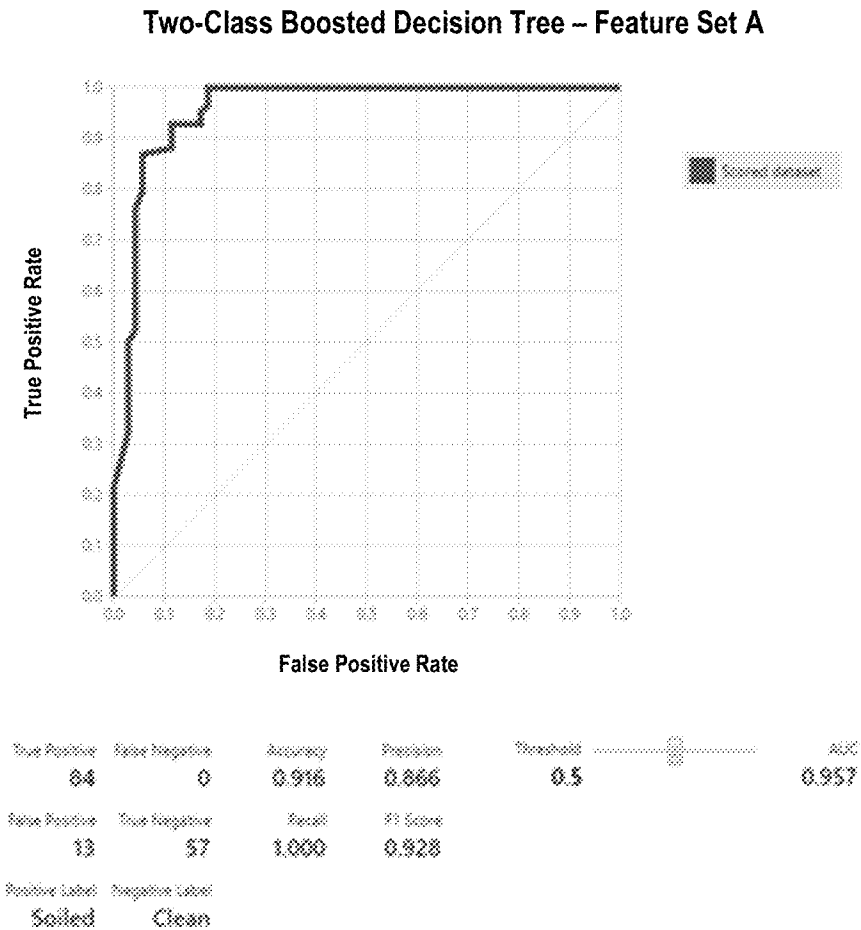
Figure 6C:
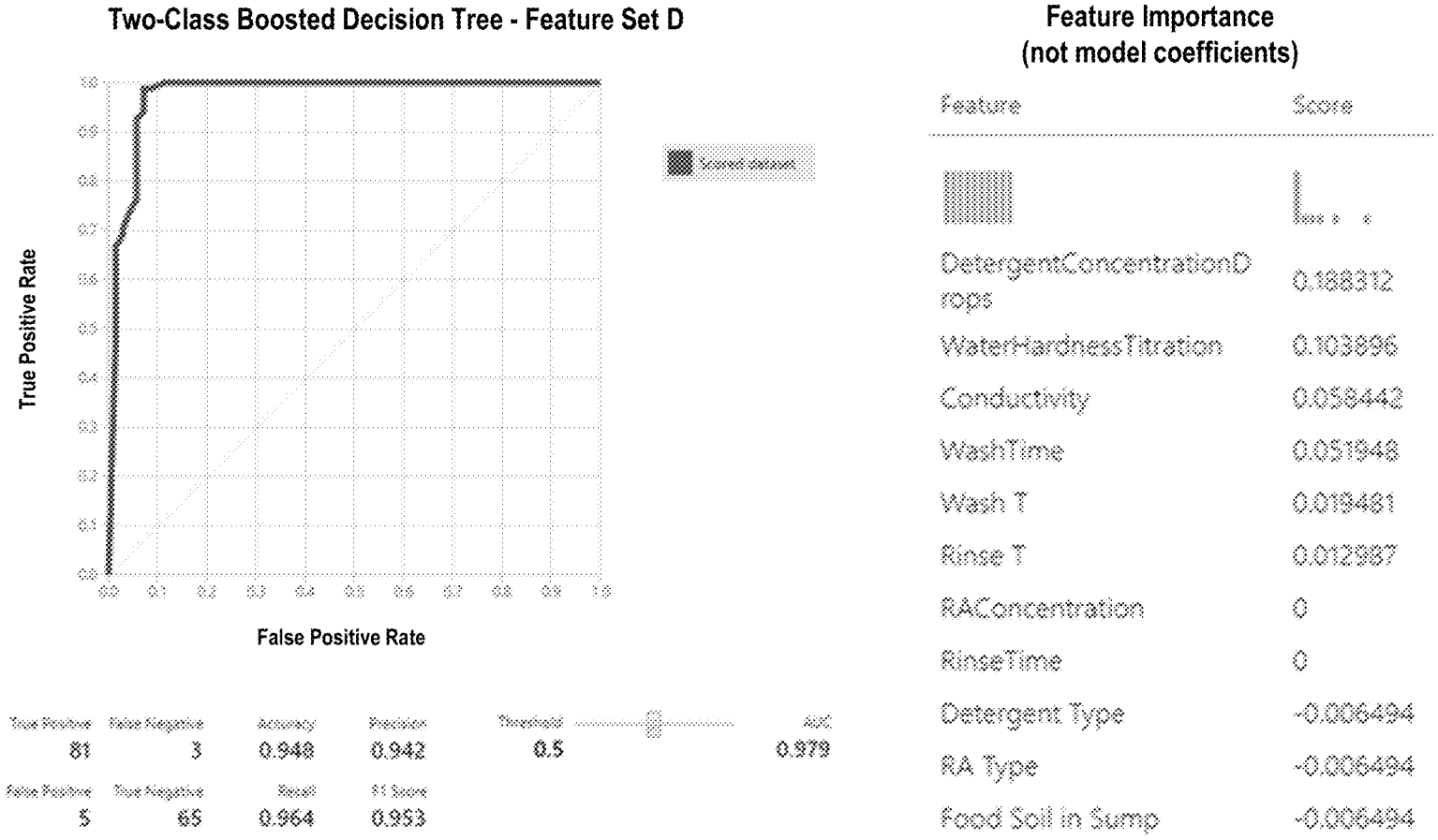

FIGS. 6A-6C are graphs illustrating example results obtained from evaluation of different binary cleaning outcome classifiers and using different feature sets. In general, the purpose of a binary cleaning outcome classifier is to predict one of two potential responses—either a "clean" outcome or a "soiled" outcome. A confusion matrix is a two by two table formed by counting of the number of the four outcomes of a binary classifier. For purposes of the present description, the positive label=soiled and a negative label=clean. The example confusion matrix is shown in Table 2.

TABLE 2

| | Clean (Predicted) | Soiled (Predicted) |
|---|---|---|
| Clean (Actual) | True Negative | False Positive |
| Soiled (Actual) | False Negative | True Positive |

Various measures can be derived from a confusion matrix, and these measures may be used to evaluate the accuracy of the binary cleaning outcome classifier. Error rate is calculated as the number of all incorrect predictions divided by the total number of the dataset. The best error rate is 0.0, whereas the worst is 1.0. Accuracy is calculated as the number of all correct predictions divided by the total number of the dataset. The best accuracy is 1.0, whereas the worst is 0.0. Accuracy may also be calculated by 1—error rate. Precision is calculated as the number of correct positive predictions divided by the total number of positive predictions. The best precision is 1.0, whereas the worst is 0.0. Matthews correlation coefficient and F-score may also be calculated for each binary cleaning outcome classifier.

FIG. 6A, for example, shows a graph of the True Positive Rate versus the False Positive Rate for an example cleaning outcome classifier generated using a two-class (binary) logistic regression model using feature set A (see Table 1). Various statistics calculated for this model, including the number of true positives (TP), false positives (FP), false negatives (FN), and true negatives (TN) are shown in the lower portion of FIG. 6A.

Logistic regression models also generate a list of features and weights which could be used to assess importance of each feature for predicting outcome within the model. These are shown in the Table on the right side of FIG. 6A. High positive values signify higher importance in predicting the positive label (soiled coupons), while large negative values signify higher importance in predicting the negative label (clean coupons).

In general, the accuracy for the two-class logistic regression model of FIG. 6A is 0.812 meaning that the model accurately predicted either "clean" or "soiled" 81.2% of the time. In this example, the most important feature was conductivity, followed by wash time and rinse temperature (negative values for the weights indicate they contribute more to the negative label=clean). The least important feature was wash temperature.

FIG. 6B shows a graph of the True Positive Rate versus the False Positive Rate for an example cleaning outcome classifier generated using a two-class boosted decision tree model using feature set A (see Table 1). Various statistics calculated for this model, including the number of true positives (TP), false positives (FP), false negatives (FN), and true negatives (TN), the accuracy, precision, recall, F1 Score and area under curve are shown in the lower portion of FIG. 6B. The accuracy statistic for this model was 0.916 for the same feature set as the model of FIG. 6A. Therefore, based on the calculations for the models of FIGS. 6A and 6B, it appears that the two-class boosted decision tree model performed better than the two-class logistic regression model (accuracy=0.812) when using feature set A in this example.

FIG. 6C shows a graph of the True Positive Rate versus the False Positive Rate for an example cleaning outcome classifier generated using a two-class boosted decision tree model using feature set D (see Table 1). Various statistics calculated for this model, including the number of true positives (TP), false positives (FP), false negatives (FN), and true negatives (TN), the accuracy, precision, recall, F1 Score and area under curve are shown in the lower portion of FIG. 6B. The accuracy statistic for this model was 0.948 for the same feature set as the model of FIG. 6A. Therefore, based on the calculations for the models of FIGS. 6B and 6C, it appears that the two-class boosted decision tree model using feature set D performed better than the two-class logistic boosted decision tree model using feature set A (accuracy=0.812) in this example.

The feature importance is shown in the Table on the right side of FIG. 6C. According to this model, detergent concentration was determined to be the most important feature in predicting a "clean" outcome, followed by water hardness titration, conductivity, wash time, wash temperature, rinse temperature, rinse aid concentration, rinse time, detergent type, rinse aid type, and food soil.

The examples of FIGS. 6A-6C are given as examples of different machine learning models and different feature sets that may be used to generate a cleaning outcome classifier in accordance with the techniques of the present disclosure. It shall be understood that these examples are not intended to be limiting, and that other machine learning models and other combinations of feature sets may be used, and that the disclosure is not limited in this respect.

Other statistics that may be determined for the example models of FIGS. 6A-6C include, but are not limited to:

Accuracy=(correctly predicted class/total testing class)*100=((TP+TN)/(TP+TN+FP+FN))*100);

Precision=(true positives/total predicted positives)*100=(TP/(TP+FP))*100). This statistic is an indicator of how precise model is. This statistic may be useful when cost of a false positive is high (e.g. a coupon that is clean is identified as soiled).

Recall=(true positives/total actual positives)*100=(TP/(TP+FN))*100. This statistic indicates how many actual positives our model captures by labeling it as positive. This statistic may be useful when the cost of a false negative is high (e.g. soiled coupon is predicted as clean).

F1 Score=2*(Precision*Recall/(Precision+Recall))—used to seek balance between precision and recall; useful when uneven class distribution (e.g. large number of True negatives).

AUC=area under curve. This statistic indicates how much the model is capable of distinguishing between clean and soiled classifications.

True Positive Rate (TPR)—the number of positives classified by the algorithm as positive divided by the total number of positives.

False Positive Rate (FPR)—the number of negatives classified by the algorithm as positive divided by the total number of negatives; FPR=FP/(TN+FP).

These and other statistics may also be calculated for other machine learning models, and it shall be understood that the disclosure is not limited in this respect.

FIG. 7 is a chart showing a summary of example classification model results for several two-class classification model tools in accordance with the present disclosure. The classification models include a two-class logistic regression model, a two-class boosted decision tree model, a two-class neural network model, a two-class Bayes-Point machine model, and a two-class support vector machine (SVM) model. Example results for each of these models is given for each of feature set A, feature set B, feature set C, and feature set D (see lists of feature sets in Table 1, above). In this example, the two-class boosted decision tree model gave the most accurate predictions for each of the feature sets.

FIG. 7 also shows an additional feature that may be included in the training data: verification coupon rack position. In some types of dish machines, for example, verification coupons placed at certain position(s) on the dish machine rack may be more indicative of cleaning efficacy as compared to verification coupons placed in other rack positions. Thus, a rack position corresponding to each verification coupon may also be included as one of the features of the training data, along with the one or more cleaning process parameters and the known outcome (e.g., "clean" or "soiled", or numeric score).

For example, verification coupons place in the back left corner of a door-type commercial dish machines may be more indicative of cleaning efficacy than verification coupons placed in other rack positions. This rack position is indicated as "Rack Position 1" in FIG. 7. When rack position is taken into account, the accuracy of the two-class logistic regression model was increased for all feature sets. In this particular example, the accuracy of the two-class boosted decision tree model was decreased for all feature sets when rack position was taken into account. This may be due to the decision tree model overfitting the data due to the low number of data points in this particular example. It shall be understood that the disclosure is not limited in this respect, and that the examples are shown are for purposes of illustrating an example process of choosing among the different machine learning models available.

In other examples, machine learning models using regression to generate a quantified value or numerical score for a cleaning outcome may also be used. FIG. 8 is a chart showing a summary of example regression model results for several regression model tools in accordance with the present disclosure. The regression models include a linear regression model, a boosted decision tree regression model, a neural network regression model, and a Bayes linear regression model. Example results for each of these models is given for each of feature set A, feature set B, feature set C, and feature set D (see lists of feature sets in Table 1, above). In this example, the boosted decision tree regression model gave the most accurate predictions for feature sets C and D and taking all rack positions into account (0.891). The rack positions included 4 coupons in 3 different positions across the rack: position 1 in the back left corner of the rack, positions 5A and 5B in center of the rack, and position 3 in the front right corner of the rack. When taking only Rack Position 1 into account, the accuracy of the boosted decision tree regression model was increased to 0.926. This may be due to the fact that in this particular type of cleaning machine, rack position 1 is the hardest to get clean due to obstacles in front of the spray path or other obstacles or inconsistencies within the wash chamber.

FIGS. 7 and 8 illustrate that many different machine learning models and different combinations of feature sets may be used to train a cleaning outcome classifier. Depending upon the type of machine, the articles to be cleaned, and other factors, different machine learning models and/or different feature sets may generate the best cleaning outcome predictions. It shall be understood, therefore, that any machine learning model may be substituted for the machine learning models described herein, and that the disclosure is not limited in this respect. In addition, it shall be understood that different combinations of feature sets, and/or additional or alternative features, may be substituted for the specific feature sets described herein, and that the disclosure is not limited in this respect.

FIG. 9 is a flowchart illustrating an example process (350) by which a computing device classifies an outcome of a novel cleaning process executed by a cleaning machine with a trained cleaning outcome classifier in accordance with the present disclosure. The computing device may include, for example, the example cleaning machine controller 200 of FIG. 1 or 4, and the process (350) may be controlled based on execution of instructions stored in cleaning process control module 212 and trained cleaning outcome classifier and executed by processor(s) 202.

At the start of a novel cleaning process (352), the computing device controls execution of the novel cleaning process using stored cleaning process parameters (354). The stored cleaning process parameters may be stored in, for example, a storage device that forms part of a cleaning machine controller, such as storage device 208 of cleaning machine controller 200 as shown in FIG. 4.

The computing device monitors one or more cleaning process parameters during execution of the cleaning process (356). The one or more cleaning process parameters monitored during the cleaning process may include parameters measured by the machine itself or sensors associated with the cleaning machine (such as sensors 220 as shown in FIG.

4), such as a wash temperature, a rinse temperature, a wash time, a rinse time, and a conductivity.

The one or more cleaning process parameters may further include product type parameters determined manually and stored in the cleaning machine controller, such as a detergent type and/or a rinse aid type. The detergent type and rinse aid type may also be determined automatically, for example, by reading an electronically readable code (such as a bar code or QR code) associated with the detergent and/or rinse aid dispensed by the product dispense system.

The one or more cleaning process parameters may further include parameters determined by one or more manual test procedures and stored in the cleaning machine controller, such as a water hardness titration and/or an alkalinity titration performed by an on-site service technician.

The one or more cleaning process parameters may further include a parameter indicative of whether food soil is present in the wash water. For example, the food soil parameter may be a Boolean parameter indicative of whether or not food soil is present in the cleaning solution (e.g., food soil "Yes" or "No"). Food soil would typically be present in commercial establishments because there is typically at least some level of food soil present in the sump (for example, sump 110 as shown in FIG. 1). In another example, the food soil parameter may be assigned a numerical value representative of the relative amount of food soil in the cleaning solution. For example, a turbidity measurement may be used as representative of the level of food soil in the cleaning solution in the sump. To that end, sensors 220 may include a turbidity sensor or other sensor that measures a parameter indicative of the amount of food soil present in the cleaning solution in the sump. In another example, if fresh water is used for every cleaning process rather than re-using cleaning solution from the sump, the food soil parameter may be set to "No" or a numerical value indicative of no food soil in the cleaning solution.

Once the cleaning process is complete (358) the computing device stores the cycle data corresponding to the cleaning process (360). The cycle data includes the one or more cleaning process parameters monitored during execution of the cleaning process or otherwise corresponding to the cleaning process. The cleaning process parameters may include, as described above, one or more of a wash temperature, a rinse temperature, a wash time, a rinse time, a conductivity, a detergent type, a rinse aid type, a water hardness titration, an alkalinity titration, a food soil and/or any other parameter that may affect the efficacy of the cleaning process.

The computing device classifies or scores the cleaning outcome with the trained cleaning outcome classifier based on selected ones of the one or more cleaning process parameters monitored during execution of the cleaning process (362). The selected cleaning process parameters comprise a feature set that are used as inputs to the trained cleaning outcome classifier. The cleaning process parameters used to classify or score the outcome of a novel cleaning process may be the same as the cleaning process parameters used to train the cleaning outcome classifier during the training phase.

When the trained cleaning outcome classifier classifies or scores the cleaning outcome, as "clean" or assigns a score indicative of a "clean" outcome (YES branch of 364), the process (300) is complete (368). When the trained cleaning outcome classifier classifies the cleaning outcome as "soiled" or assigns a score indicative of a "soiled" cleaning outcome (e.g., a score less than a threshold value) (NO branch of 364), the computing device adjusts the stored cleaning process parameters to ensure a satisfactory cleaning outcome for subsequent cleaning process executed by the cleaning machine (366). For example, the computing device may predict a cleaning outcome classification or score for one or more hypothetical cleaning processes, each using a different set of adjusted cleaning process parameters. The computing device may then select the set of adjusted cleaning process parameters that led to a "clean" prediction for the cleaning outcome classification or score to be used for one or more subsequent cleaning processes.

Figure 10:
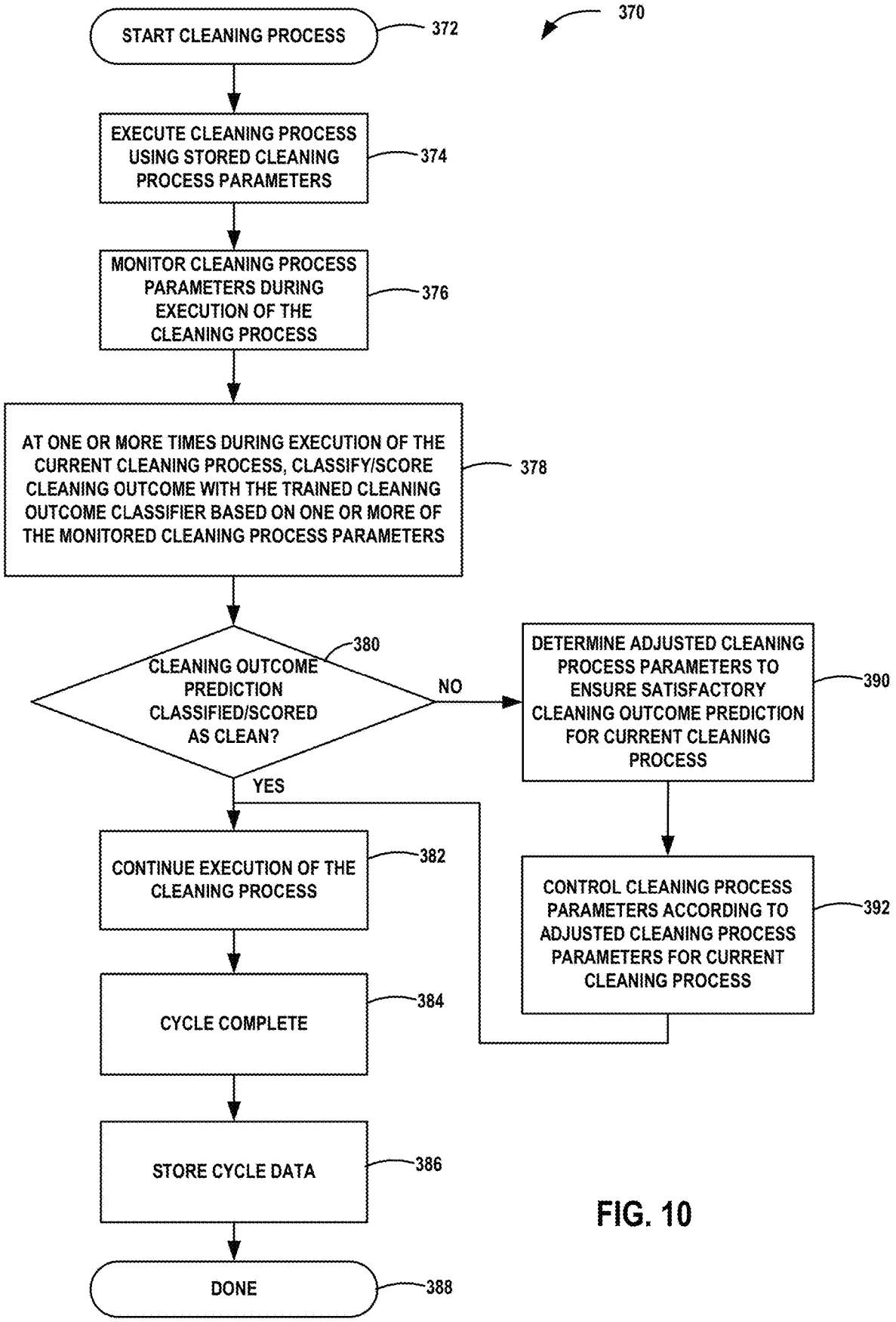
FIG. 10 is a flowchart illustrating an example process by which a computing device predicts, using a trained cleaning process classifier, a cleaning outcome for a current novel cleaning process and dynamically adjusts one or more cleaning process parameters during execution of the current cleaning process to ensure a satisfactory cleaning outcome in accordance with the present disclosure.

FIG. 10 is a flowchart illustrating an example process (370) by which a computing device predicts, using a trained cleaning process classifier, a cleaning outcome for a current novel cleaning process and dynamically adjusts one or more cleaning process parameters during execution of the current cleaning process to ensure a satisfactory cleaning outcome in accordance with the present disclosure. The computing device may include, for example, the example cleaning machine controller 200 of FIG. 1 or 4, and the process (370) may be controlled based on execution of instructions stored in cleaning process control module 212 and trained cleaning outcome classifier and executed by processor(s) 202.

At the start of a novel cleaning process (372), the computing device controls execution of the current novel cleaning process using stored cleaning process parameters (374). The stored cleaning process parameters may be stored in, for example, a storage device that forms part of a cleaning machine controller, such as storage device 208 of cleaning machine controller 200 as shown in FIG. 4.

The computing device monitors one or more cleaning process parameters during execution of the current novel cleaning process (376). The one or more cleaning process parameters monitored during the current novel cleaning process may include parameters discussed above with respect to FIG. 9, for example, such as a wash temperature, a rinse temperature, a wash time, a rinse time, and a conductivity, product type parameters determined manually and stored in the cleaning machine controller, such as a detergent type and/or a rinse aid type. The detergent type and rinse aid type may also be determined automatically, for example, by reading an electronically readable code (such as a bar code or QR code) associated with the detergent and/or rinse aid dispensed by the product dispense system, parameters determined by one or more manual test procedures and stored in the cleaning machine controller, such as a water hardness titration and/or an alkalinity titration performed by an on-site service technician, a parameter indicative of whether food soil is present in the wash water, a measurement of food soil presence in the water, etc.

The one or more cleaning process parameters may be measured at one or more times during execution of the cleaning process. For example, one or more of the cleaning process parameters may be measured continuously at a predetermined sampling rate during execution of the cleaning process. Some of the cleaning process parameters may be measured at different times or at different rates, or at a single point in time, or before or after the cleaning process.

At one or more times during execution of the current novel cleaning process, the computing device may classify or score the cleaning outcome using the trained cleaning outcome classifier based on one or more of the monitored cleaning process parameters associated with that time (378). For example, at a predetermined time after the start of the cleaning process, the computing device may classify or score the cleaning outcome using the trained cleaning outcome classifier based on one or more of the cleaning process parameters monitored at or before the predetermined time (378). The predetermined time may be, for example, some predetermined number of seconds after the start of the cleaning process, such as 5 seconds, 10 seconds, 15 seconds, or other predetermined number of seconds after the start of the cleaning process. If the predicted outcome based on the cleaning process parameters associated with the predetermined time is "soiled" or unsatisfactory (NO branch of 380), the computing device may dynamically adjust the cleaning process parameters to ensure a satisfactory cleaning outcome for the current novel cleaning process (390). The computing device then controls the remainder of the current novel cleaning process according to the adjusted cleaning process parameters (392).

As another example, the computing device may classify or score the cleaning outcome using the trained cleaning outcome classifier based on one or more of the cleaning process parameters monitored measured during each of one or more sampling periods (378). For example, if the sampling period is 1 second, the computing device may predict a classification or score for the cleaning outcome associated with each 1 second sampling period. If the predicted outcome for any one or more of the sampling periods is "soiled" or otherwise unsatisfactory (NO branch of 380), the computing device may dynamically adjust the cleaning process parameters to ensure a satisfactory cleaning outcome for the current novel cleaning process (390). Alternatively, the computing device may require a minimum number of sampling periods to have a corresponding "soiled" cleaning outcome prediction before dynamically adjusting the cleaning process parameters of the current novel cleaning process.

The adjusted cleaning process parameters may be determined (390) by predicting cleaning outcomes for one or more different sets of adjusted cleaning process parameters, and selecting one of the sets of the sets of adjusted cleaning process parameters that resulted in a "clean" prediction for the current novel cleaning process. The computing device then controls the remainder of the current novel cleaning process according to the adjusted cleaning process parameters (392).

If the predicted outcome(s) at the one or more predetermined time(s) or for any one or more of the sampling periods is "clean" or otherwise satisfactory (YES branch of 380), the computing device continues execution of the current novel cleaning process using the original cleaning process parameters (382).

Once the cleaning process is complete (384) the computing device stores the cycle data corresponding to the cleaning process (386). The cycle data includes the one or more cleaning process parameters monitored during execution of the cleaning process or otherwise corresponding to the cleaning process. The cleaning process parameters may include, as described above, one or more of one or more of a wash temperature, a rinse temperature, a wash time, a rinse time, a conductivity of the wash water, a detergent type, a rinse aid type, a water hardness of the wash water, an alkalinity of the wash water, and/or a measurement of food soil presence in the wash water and/or any other parameter that may affect the efficacy of the cleaning process.

Although the examples presented herein are described with respect to automated cleaning machines for use in food preparation/processing applications (e.g., dish machines or ware wash machines), it shall be understood that the techniques for classification and/or scoring of cleaning outcomes described herein may be applied to a variety of other applications. Such applications may include, for example, food and/or beverage processing equipment, laundry applications, agricultural applications, hospitality applications, and/or any other application in which cleaning, disinfecting, or sanitizing of articles may be useful.

In one or more examples, the functions described herein may be implemented in hardware, software, firmware, or any combination thereof. If implemented in software, the functions may be stored on or transmitted over, as one or more instructions or code, a computer-readable medium and executed by a hardware-based processing unit. Computer-readable media may include computer-readable storage media, which corresponds to a tangible medium such as data storage media, or communication media including any medium that facilitates transfer of a computer program from one place to another, e.g., according to a communication protocol. In this manner, computer-readable media generally may correspond to (1) tangible computer-readable storage media, which is non-transitory or (2) a communication medium such as a signal or carrier wave. Data storage media may be any available media that can be accessed by one or more computers or one or more processors to retrieve instructions, code and/or data structures for implementation of the techniques described in this disclosure. A computer program product may include a computer-readable medium.

By way of example, and not limitation, such computer-readable storage media can comprise RAM, ROM, EEPROM, CD-ROM or other optical disk storage, magnetic disk storage, or other magnetic storage devices, flash memory, or any other medium that can be used to store desired program code in the form of instructions or data structures and that can be accessed by a computer. Also, any connection is properly termed a computer-readable medium. For example, if instructions are transmitted from a website, server, or other remote source using a coaxial cable, fiber optic cable, twisted pair, digital subscriber line (DSL), or wireless technologies such as infrared, radio, and microwave, then the coaxial cable, fiber optic cable, twisted pair, DSL, or wireless technologies such as infrared, radio, and microwave are included in the definition of medium. It should be understood, however, that computer-readable storage media and data storage media do not include connections, carrier waves, signals, or other transient media, but are instead directed to non-transient, tangible storage media. Disk and disc, as used, includes compact disc (CD), laser disc, optical disc, digital versatile disc (DVD), floppy disk and Blu-ray disc, where disks usually reproduce data magnetically, while discs reproduce data optically with lasers. Combinations of the above should also be included within the scope of computer-readable media.

Instructions may be executed by one or more processors, such as one or more digital signal processors (DSPs), general purpose microprocessors, application specific integrated circuits (ASICs), field programmable logic arrays (FPGAs), or other equivalent integrated or discrete logic circuitry. Accordingly, the term "processor," as used may refer to any of the foregoing structure or any other structure suitable for implementation of the techniques described. In addition, in some examples, the functionality described may be provided within dedicated hardware and/or software modules. Also, the techniques could be fully implemented in one or more circuits or logic elements.

The techniques of this disclosure may be implemented in a wide variety of devices or apparatuses, including a wireless handset, an integrated circuit (IC) or a set of ICs (e.g., a chip set). Various components, modules, or units are described in this disclosure to emphasize functional aspects of devices configured to perform the disclosed techniques, but do not necessarily require realization by different hardware units. Rather, as described above, various units may be combined in a hardware unit or provided by a collection of interoperative hardware units, including one or more processors as described above, in conjunction with suitable software and/or firmware.

It is to be recognized that depending on the example, certain acts or events of any of the methods described herein can be performed in a different sequence, may be added, merged, or left out altogether (e.g., not all described acts or events are necessary for the practice of the method). Moreover, in certain examples, acts or events may be performed concurrently, e.g., through multi-threaded processing, interrupt processing, or multiple processors, rather than sequentially.

In some examples, a computer-readable storage medium may include a non-transitory medium. The term "non-transitory" may indicate that the storage medium is not embodied in a carrier wave or a propagated signal. In certain examples, a non-transitory storage medium may store data that can, over time, change (e.g., in RAM or cache).

EXAMPLES

Example 1: An automated cleaning machine comprising at least one processor; at least one storage device that stores one or more predefined cleaning process parameters and a trained cleaning outcome classifier; the at least one storage device further comprising instructions executable by the at least one processor to: control execution by the cleaning machine of at least one cleaning process using the one or more predefined cleaning process parameters; monitor one or more cleaning process parameters during execution of the cleaning process; classify or score the outcome of the cleaning process using the trained cleaning process classifier based on the one or more cleaning process parameters monitored during execution of the cleaning process; and in response to the trained cleaning process classifier classifying the outcome of the cleaning process as soiled, adjusting one or more of the predefined cleaning process parameters such that a subsequent cleaning process will be classified as clean by the trained cleaning outcome classifier.

Example 2: The automated cleaning machine of Example 1, wherein the trained cleaning process classifier classifies the outcome of the cleaning process as one of clean or soiled.

Example 3: The automated cleaning machine of Example 1, wherein the trained cleaning process classifier scores the outcome of the cleaning process by assigning a numerical score indicative of the cleaning outcome.

Example 4: The automated cleaning machine of Example 1, wherein the one or more cleaning cycle parameters include one or more of a wash temperature, a rinse temperature, a wash time, a rinse time, a conductivity of the wash water, a detergent type, a rinse aid type, a water hardness of the wash water, an alkalinity of the wash water, and/or a measurement of food soil presence in the wash water.

Example 5: The automated cleaning machine of Example 4, wherein the measurement of food soil presence is a Boolean parameter having a first possible values of food soil=true and a second possible value of food soil=false.

Example 6: The automated cleaning machine of Example 4, wherein the measurement of food soil presence comprises a turbidity measurement of cleaning solution in a sump of the cleaning machine.

Example 7: The automated cleaning machine of Example 1, wherein the trained cleaning outcome classifier is one of a trained two-class classification machine learning model or a trained regression machine learning model.

Example 8: The automated cleaning machine of Example 1, wherein the at least one storage device further comprising instructions executable by the at least one processor to control execution by the cleaning machine of a subsequent cleaning process using the adjusted one or more predefined cleaning process parameters.

Example 9: The automated cleaning machine of Example 1, wherein the trained cleaning outcome classifier is trained using training data obtained from one or more designed experiments or field tests in which one or more cleaning process verification coupons are placed in a wash chamber of a cleaning machine and exposed to a cleaning process executed by the cleaning machine during a training phase.

Example 10: The automated cleaning machine of Example 1, wherein the trained cleaning outcome classifier is trained based on one or more cleaning process parameters corresponding to each of a plurality of cleaning processes executed during a training phase and a known output corresponding to each of the plurality of cleaning processes executed during the training phase.

Example 11: A method comprising storing, in a storage device of an automated cleaning machine, one or more predefined cleaning process parameters and a trained cleaning outcome classifier; controlling, by a controller of the automated cleaning machine, execution by the cleaning machine of at least one cleaning process using the one or more predefined cleaning process parameters; monitoring, by the controller of the automated cleaning machine, one or more cleaning process parameters during execution of the cleaning process; classifying or scoring, by the controller of the automated cleaning machine, the outcome of the cleaning process using the trained cleaning process classifier based on the one or more cleaning process parameters monitored during execution of the cleaning process; and in response to the trained cleaning process classifier classifying the outcome of the cleaning process as soiled, adjusting, by the controller of the automated cleaning machine, one or more of the predefined cleaning process parameters such that a subsequent cleaning process will be classified as clean by the trained cleaning outcome classifier.

Example 12: The method of Example 11, wherein the trained cleaning process classifier classifies the outcome of the cleaning process as one of clean or soiled.

Example 13: The method of Example 11, wherein the trained cleaning process classifier scores the outcome of the cleaning process by assigning a numerical score indicative of the cleaning outcome.

Example 14: The method of Example 11, wherein the one or more cleaning cycle parameters include one or more of a wash temperature, a rinse temperature, a wash time, a rinse time, a conductivity of the wash water, a detergent type, a rinse aid type, a water hardness of the wash water, an alkalinity of the wash water, and/or a measurement of food soil presence in the wash water.

Example 15: The method of Example 14, wherein the measurement of food soil presence is a Boolean parameter having a first possible values of food soil=true and a second possible value of food soil=false.

Example 16: The method of Example 14, wherein the measurement of food soil presence comprises a turbidity measurement of cleaning solution in a sump of the cleaning machine.

Example 17: The method of Example 11, wherein the trained cleaning outcome classifier is one of a trained two-class classification machine learning model or a trained regression machine learning model.

Example 18: The method of Example 11, further including controlling execution by the cleaning machine of at least one cleaning process using the one or more predefined cleaning process parameters.

Example 19: The method of Example 11, wherein the trained cleaning outcome classifier is trained using training data obtained from one or more designed experiments or field tests in which one or more cleaning process verification coupons are placed in a wash chamber of a cleaning machine and exposed to a cleaning process executed by the cleaning machine during a training phase.

Example 20: The method of Example 11, wherein the trained cleaning outcome classifier is trained based on one or more cleaning process parameters corresponding to each of a plurality of cleaning processes executed during a training phase and a known output corresponding to each of the plurality of cleaning processes executed during the training phase.

Example 21: An automated cleaning machine comprising at least one processor; at least one storage device that stores one or more predefined cleaning process parameters and a trained cleaning outcome classifier; the at least one storage device further comprising instructions executable by the at least one processor to: control execution by the cleaning machine of at least one cleaning process using the one or more predefined cleaning process parameters; monitor one or more cleaning process parameters during execution of the cleaning process; classify or score the outcome of the cleaning process using the trained cleaning process classifier based on the one or more cleaning process parameters monitored during execution of the cleaning process; in response to the trained cleaning process classifier classifying the outcome of the cleaning process as soiled, dynamically adjusting one or more of the predefined cleaning process parameters such that the cleaning process is classified as clean by the trained cleaning outcome classifier; and control execution by the cleaning machine of a remainder of the cleaning process using the dynamically adjusted one or more of the predefined cleaning process parameters.

Various examples have been described. These and other examples are within the scope of the following claims.

The invention claimed is:

1. A method comprising:

storing, in a storage device of an automated cleaning machine, predefined values of one or more cleaning process parameters and a trained cleaning process classifier, wherein the trained cleaning process classifier is a trained two-class classification machine learning model and is configured to classify outcomes of cleaning processes of the automated cleaning machine as either clean or soiled;

controlling, by a controller of the automated cleaning machine, execution by the automated cleaning machine of at least a first cleaning process of the automated cleaning machine using the predefined values of the one or more cleaning process parameters;

monitoring, by the controller of the automated cleaning machine, measured values of the one or more cleaning process parameters during execution of the first cleaning process;

classifying, by the controller of the automated cleaning machine, an outcome of the first cleaning process using the trained cleaning process classifier based on the measured values of the one or more cleaning process parameters;

in response to the trained cleaning process classifier classifying the outcome of the first cleaning process as soiled:

using, by the controller of the automated cleaning machine, the trained cleaning process classifier to predict cleaning outcomes for a plurality of different sets of adjusted values of the one or more cleaning process parameters; and selecting, by the controller of the automated cleaning machine, one of the sets of adjusted values of the one or more cleaning process parameters that resulted in a clean prediction for the first cleaning process; and controlling execution by the automated cleaning machine of the first cleaning process or a second cleaning process of the automated cleaning machine using the adjusted values of the one or more cleaning process parameters.

2. The method of claim 1, wherein the trained cleaning process classifier is trained using training data obtained from one or more designed experiments or field tests in which one or more cleaning process verification coupons are placed in wash chambers of one or more cleaning machines and exposed to a cleaning process executed by the one or more cleaning machine during a training phase.

3. The method of claim 1, wherein the trained cleaning process classifier is trained based on one or more cleaning process parameters corresponding to each of a plurality of cleaning processes executed during a training phase and a known output corresponding to each of the plurality of cleaning processes executed during the training phase.

4. The method of claim 1, wherein the one or more cleaning process parameters include one or more of a wash temperature, a rinse temperature, a wash time, a rinse time, a conductivity of wash water, a detergent type, a rinse aid type, a water hardness of the wash water, an alkalinity of the wash water, and/or a measurement of food soil presence in the wash water.

5. The method of claim 4, wherein the measurement of food soil presence is a Boolean parameter having a first possible value of food soil=true and a second possible value of food soil=false.

6. The method of claim 4, wherein the measurement of food soil presence comprises a turbidity measurement of cleaning solution in a sump of the automated cleaning machine.

7. An automated cleaning machine comprising:

at least one processor; and at least one storage device that stores predefined values of one or more cleaning process parameters and a trained cleaning process classifier, wherein the trained cleaning process classifier is a trained two-class classification machine learning model and is configured to classify outcomes of cleaning processes of the automated cleaning machine as either clean or soiled;

the at least one storage device further comprising instructions executable by the at least one processor to:

control execution by the automated cleaning machine of at least one of the cleaning processes using the predefined values of the one or more cleaning process parameters;

monitor measured values of the one or more cleaning process parameters during execution of the cleaning process;

classify an outcome of the cleaning process using the trained cleaning process classifier based on the measured values of the one or more cleaning process parameters;

in response to the trained cleaning process classifier classifying the outcome of the cleaning process as soiled:

use the trained cleaning process classifier to predict cleaning outcomes for a plurality of different sets of adjusted values of the one or more cleaning process parameters; and select one of the sets of adjusted values of the one or more cleaning process parameters that resulted in a clean prediction for the cleaning process; and control execution by the automated cleaning machine of a remainder of the cleaning process using the selected set of adjusted values of the one or more cleaning process parameters.

8. An automated cleaning machine comprising:

at least one processor; and at least one storage device that stores predefined values of one or more cleaning process parameters and a trained cleaning process classifier, wherein the trained cleaning process classifier is a trained two-class classification machine learning model and is configured to classify outcomes of cleaning processes of the automated cleaning machine as either clean or soiled;

the at least one storage device further comprising instructions executable by the at least one processor to:

control execution by the automated cleaning machine of at least a first cleaning process using the predefined values of the one or more cleaning process parameters;

monitor measured values of the one or more cleaning process parameters during execution of the first cleaning process;

classify an outcome of the first cleaning process using the trained cleaning process classifier based on the measured values of the one or more cleaning process parameters;

in response to the trained cleaning process classifier classifying the outcome of the first cleaning process as soiled:

use the trained cleaning process classifier to predict cleaning outcomes for a plurality of different sets of adjusted values of the one or more cleaning process parameters; and select one of the sets of adjusted values of the one or more cleaning process parameters that resulted in a clean prediction for the first cleaning process; and control execution by the automated cleaning machine of a subsequent second cleaning process using the selected set of adjusted values of the one or more cleaning process parameters.

9. The automated cleaning machine of claim 8, wherein the trained cleaning process classifier is trained using training data obtained from one or more designed experiments or field tests in which one or more cleaning process verification coupons are placed in wash chambers of one or more cleaning machines and exposed to a cleaning process executed by the one or more cleaning machines during a training phase.

10. The automated cleaning machine of claim 8, wherein the trained cleaning process classifier is trained based on one or more cleaning process parameters corresponding to each of a plurality of cleaning processes executed during a training phase and a known output corresponding to each of the plurality of cleaning processes executed during the training phase.

11. The automated cleaning machine of claim 8, wherein the one or more cleaning process parameters include one or more of a wash temperature, a rinse temperature, a wash time, a rinse time, a conductivity of wash water, a detergent type, a rinse aid type, a water hardness of the wash water, an alkalinity of the wash water, and/or a measurement of food soil presence in the wash water.

12. The automated cleaning machine of claim 11, wherein the measurement of food soil presence is a Boolean parameter having a first possible values of food soil=true and a second possible value of food soil=false.

13. The automated cleaning machine of claim 11, wherein the measurement of food soil presence comprises a turbidity measurement of cleaning solution in a sump of the automated cleaning machine.

* * * * *